US011814934B2

(12) United States Patent
Wells et al.

(10) Patent No.: US 11,814,934 B2
(45) Date of Patent: Nov. 14, 2023

(54) DETONATOR ASSEMBLIES FOR PERFORATING GUN SYSTEMS

(71) Applicant: G&H Diversified Manufacturing LP, Houston, TX (US)

(72) Inventors: Joe Noel Wells, Lindale, TX (US); Eduardo Moniet, Edinburg, TX (US); Benjamin Vascal Knight, Katy, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 144 days.

(21) Appl. No.: 17/376,544

(22) Filed: Jul. 15, 2021

(65) Prior Publication Data

US 2022/0018226 A1 Jan. 20, 2022

Related U.S. Application Data

(60) Provisional application No. 63/052,413, filed on Jul. 15, 2020.

(51) Int. Cl.
*E21B 43/1185* (2006.01)

(52) U.S. Cl.
CPC ..... *E21B 43/1185* (2013.01)

(58) Field of Classification Search
CPC ..... E21B 43/116; E21B 43/117; E21B 43/11855; E21B 43/11857; E21B 43/1185
USPC ..... 89/1.51
See application file for complete search history.

(56) References Cited

U.S. PATENT DOCUMENTS 4,011,815 A * 3/1977 Garcia ..... E21B 43/117 175/4.51
4,314,614 A * 2/1982 McPhee ..... F42C 15/34 102/260
4,523,650 A 6/1985 Sehnert et al.
5,027,708 A 7/1991 Gonzalez et al.
5,070,788 A 12/1991 Carisella
5,115,865 A 5/1992 Carisella
5,159,146 A 10/1992 Carisella
5,165,489 A * 11/1992 Langston ..... F42D 1/043 175/4.54
5,223,665 A 6/1993 Burleson et al.
5,277,262 A * 1/1994 Huber ..... E21B 34/102 175/4.54
8,113,119 B2 * 2/2012 Crawford ..... F42C 15/32 102/314

(Continued)

FOREIGN PATENT DOCUMENTS

WO 2019/098990 A1 5/2019

*Primary Examiner* — John Cooper
(74) *Attorney, Agent, or Firm* — Conley Rose, P.C.

(57) ABSTRACT

A perforating gun system includes a detonator configured to detonate one or more shaped charge in response to receiving a signal, a detonator holder including a pair of opposed longitudinal ends, a first passage extending along a first axis and configured to receive a detonating cord, and a second passage extending parallel to, but laterally offset from, the first passage, wherein the second passage is configured to receive the detonator, and an interrupter removeably positionable within the detonator holder laterally between the first passage and the second passage to block ballistic communication between the detonator and the detonating cord when the detonating cord is received in the first passage and the detonator is received in the second passage.

23 Claims, 12 Drawing Sheets

(56) References Cited

U.S. PATENT DOCUMENTS

| | | | | |
|---|---|---|---|---|
| 8,424,455 | B2 | 4/2013 | Crawford | |
| 8,789,467 | B2 | 7/2014 | Crawford | |
| 9,593,548 | B2 | 3/2017 | Hill et al. | |
| 10,077,641 | B2 | 9/2018 | Rogman et al. | |
| 10,584,950 | B2 | 3/2020 | Saltarelli et al. | |
| 11,460,281 | B2 * | 10/2022 | LeClair | F42D 5/00 |
| 2004/0216632 | A1 | 11/2004 | Finsterwald | |
| 2015/0330192 | A1 * | 11/2015 | Rogman | E21B 43/1185 166/297 |
| 2019/0323810 | A1 | 10/2019 | Saltarelli et al. | |
| 2019/0368321 | A1 * | 12/2019 | Eitschberger | E21B 23/10 |
| 2021/0172298 | A1 * | 6/2021 | Knight | E21B 43/117 |

* cited by examiner

DETONATOR ASSEMBLIES FOR PERFORATING GUN SYSTEMS

CROSS-REFERENCE TO RELATED APPLICATIONS

This application claims benefit of U.S. provisional patent application Ser. No. 63/052,413 filed Jul. 15, 2020, and entitled "Detonator Assembly for a Perforating Gun" which is hereby incorporated herein by reference in its entirety for all purposes.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun system at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices of the perforating gun system are installed within the wellbore between each production zone prior to perforation activities. In some applications, one or more of the perforating guns and/or other components of the perforating gun system may comprise a detonator for firing a charge or explosive. For instance, a perforating gun of the perforating gun system may comprise an initiator assembly configured to initiate an explosion of one or more shaped charged of the perforating gun in response to receiving an electrical signal from the surface. In some applications, in order to eliminate the possibility of inadvertently firing the perforating gun during transport of the perforating gun to a wellsite, the detonator may only be assembled with the other components of the perforating gun once the perforating gun is located at the wellsite.

SUMMARY OF THE DISCLOSURE

An embodiment of a perforating system comprises a detonator configured to detonate one or more shaped charge in response to receiving a signal; a detonator holder comprising a pair of opposed longitudinal ends, a first passage extending along a first axis and configured to receive a detonating cord, and a second passage extending parallel to, but laterally offset from, the first passage, wherein the second passage is configured to receive the detonator; and an interrupter removeably positionable within the detonator holder laterally between the first passage and the second passage to block ballistic communication between the detonator and the detonating cord when the detonating cord is received in the first passage and the detonator is received in the second passage. In some embodiments, the detonator holder further comprises a first interrupter opening and a second interrupter opening positioned opposite the first interrupter opening, and wherein the interrupter is insertable through both the first interrupter opening and the second interrupter opening. In some embodiments, the interrupter comprises a first plate and a support member extending at a non-zero angle from the first plate whereby a bend is formed between the first plate and the support member. In certain embodiments, the first plate comprises a first generally planar member and the support member comprises a second generally planar member. In certain embodiments, the interrupter has a generally L-shaped cross-section. In some embodiments, the non-zero angle is between 60 degrees and 120 degrees. In some embodiments, the non-zero angle is between 80 degrees and 110 degrees. In some embodiments, the detonator holder comprises one or more lateral openings that extend entirely through the detonator holder, and wherein the one or more lateral openings are positioned laterally adjacent to the second passage. In certain embodiments, the perforating gun system comprises a cylindrical outer housing; a charge carrier assembly receivable in the outer housing, wherein the charge carrier assembly comprises a charge carrier, the one or more shaped charges coupled to the charge carrier, a first endplate coupled to a first end of the charge carrier, and a second endplate coupled to the second charge carrier; and wherein the first endplate comprises the detonator holder.

An embodiment of a perforating gun system comprises a detonator configured to detonate one or more shaped charges in response to receiving a signal; a detonator holder comprising a pair of opposed longitudinal ends, a first passage configured to receive a detonating cord, and a second passage configured to receive the detonator; and an interrupter removeably positionable within the detonator holder between the first passage and the second passage to block ballistic communication between the detonator and the detonating cord when the detonating cord is received in the first passage and the detonator is received in the second passage, and wherein the interrupter comprises a first plate and a support member extending at a non-zero angle from the first plate whereby a bend is formed between the first plate and the support member. In some embodiments, the non-zero angle is between 60 degrees and 120 degrees. In some embodiments, the non-zero angle is between 80 degrees and 110 degrees. In certain embodiments, the first plate comprises a first generally planar member and the support member comprises a second generally planar member. In certain embodiments, a length of the first generally planar member is greater than a thickness of the first generally planar member. In some embodiments, the interrupter has a generally L-shaped cross-section. In some embodiments, the first passage extends parallel with, but laterally offset from, the second passage. In certain embodiments, the detonator holder comprises a first interrupter opening and a second interrupter opening positioned opposite the first interrupter opening, and wherein the interrupter is insertable through both the first interrupter opening and the second interrupter opening. In certain embodiments, the detonator holder comprises one or more openings that extend entirely through the detonator holder, and wherein the one or more openings are positioned adjacent to the second passage. In embodiments, the perforating gun system comprises a cylindrical outer housing; a charge carrier assembly receivable in the outer housing, wherein the charge carrier assembly comprises a charge carrier, the one or more shaped charges coupled to the charge carrier, a first endplate coupled to a first end of the charge carrier, and a second endplate coupled to the second charge carrier; and wherein the first endplate comprises the detonator holder.

An embodiment of a method for assembling a perforating gun system comprises (a) inserting an interrupter into a detonator holder positioned between a first passage and a second passage of the detonator holder, wherein the interrupter comprises a first plate and a support member extending at a non-zero angle from the first plate whereby a bend is formed between the first plate and the support member; (b) inserting a detonating cord into the second passage of the detonator holder; and (c) inserting the detonator into the first passage of the detonator holder whereby ballistic communication between the detonator and the detonating cord is blocked by the interrupter. In some embodiments, the method comprises (d) removing the interrupter from the detonator holder to enable a ballistic connection between the detonator and the detonating cord. In some embodiments, the first plate comprises a first generally planar member and the support member comprises a second generally planar member. In certain embodiments, the first passage extends parallel with, but laterally offset from, the second passage.

BRIEF DESCRIPTION OF THE DRAWINGS

For a detailed description of exemplary embodiments of the disclosure, reference will now be made to the accompanying drawings in which.

DETAILED DESCRIPTION

Figure 1:
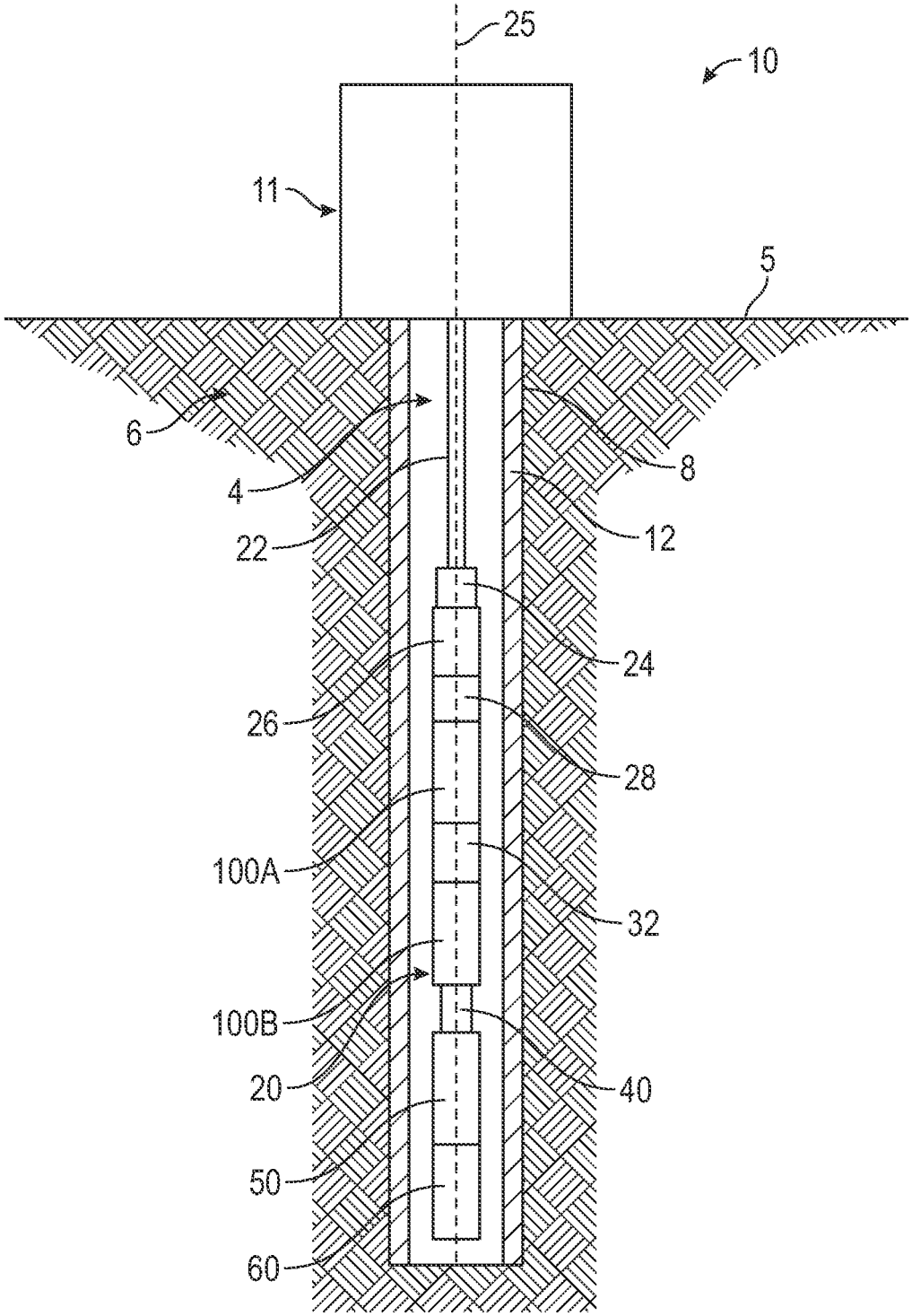
FIG. 1 is a schematic, view of an embodiment of a system for completing a subterranean well.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

As described above, during completion operations for a subterranean wellbore, it is conventional practice to perforate the wellbore and any casing pipes disposed therein with a perforating gun system at each production zone to provide a path(s) for formation fluids to flow from a production zone of a subterranean formation into the wellbore. The perforating gun system may comprise a tool string insertable into the wellbore via a wireline extending from the tool string to the surface. The tool string may be injectable into the wellbore via a surface assembly of the perforating gun system and may include a plurality of perforating guns and associated components such as a downhole plug, a setting tool for setting the downhole plug, as well as other components.

The tool string may be assembled at the wellsite prior to being injected into the wellbore by the surface assembly of the perforating gun system. Additionally, individual components of the tool string may also be assembled prior to, or as part of, assembling the tool string. For example, in at least some conventional perforating gun systems, a detonator may be assembled with the perforating gun of the tool string at the wellsite during the assembly of the tool string. Particularly, in at least some conventional perforating gun systems, the detonator may be manually electrically connected (e.g., manually wired) to an electrical switch associated with the perforating gun at the wellsite. The electrical switch may selectably trigger the detonation of the detonator in response to receiving an appropriate firing signal from the surface assembly of the conventional perforating gun system.

In addition to connecting the detonator to the electrical switch, in at least some conventional perforating gun systems, the detonator may be ballistically connected with the det cord of the perforating gun at the wellsite. As used herein, the term "ballistic connection," "ballistic coupling," and "ballistic communication" is defined as meaning a connection such that a ballistic signal may be transferred from a first component (e.g., a det cord) to a second component (e.g., a shaped charge) in response to the detonation of the first component. In other words, a second component ballistically coupled to a first component will detonate in response to the detonation of the first component unless, as further described herein, the ballistic connection is blocked by an interrupter.

As an example of ballistically connecting the detonator with the det cord of the perforating gun at the wellsite, the detonator may be manually connected to a detonator holder configured to retain the detonator in a desired proximity with the det cord such that a reliable ballistic connection is ensured between the detonator and det cord. The reliability of the ballistic connection between the detonator and det cord may be negatively correlated with the physical distance separating the detonator and det cord. In other words, the greater the spacing between the detonator and the det cord, the greater the likelihood that a given detonator may inadvertently fail to detonate a det cord following the detonation of the detonator.

Thus, the detonator of each perforating gun of the conventional perforating gun system may need be assembled at the wellsite. The detonators may not be preassembled with their associated conventional perforating guns at a central location (e.g., a facility for manufacturing the perforating gun) given the danger present in transporting a perforating gun to the wellsite which includes a detonator ballistically connected to one or more shaped charges. Particularly, there may be too great a danger of the shaped charge being inadvertently detonated during transport of the perforating gun if it were to be ballistically connected to a detonator (via the det cord) during transport. However, the need to assemble the detonator with the perforating gun at the wellsite may increase the time required for performing a stimulation or hydraulic fracturing operation using the conventional perforating gun system, thereby increasing the expense associated with performing the stimulation or fracturing operation.

Accordingly, embodiments of perforating gun systems disclosed herein include an interrupter positionable within a detonator holder and between a detonator and a det cord whereby the interrupter may block or sever a ballistic connection that would otherwise be formed between the detonator and det cord when each are received in the detonator holder. By blocking the ballistic connection between the detonator may be preassembled with the perforating gun system prior to transport to the wellsite, thereby minimizing the time required for assembling the tool string at the wellsite. By minimizing the time required for assembling the tool string, the time required for performing a stimulation or hydraulic fracturing operation using the perforating gun system may be minimized, in-turn minimizing the expense associated with performing the operation.

Additionally, embodiments of interrupters disclosed herein are configured to selectably block a ballistic connection between a detonator and det cord while also minimizing the spacing between the detonator and det cord such that a reliable ballistic connection is established between the detonator and det cord following the removal of the interrupter. Particularly, embodiments of interrupters disclosed herein include a first plate and a support member extending at a non-zero angle from the first plate whereby a bend is formed between the first plate and the support member. The bend formed between the first plate and the support member may increase a structural rigidity of the interrupter such that a thickness of the interrupter may be minimized while also ensuring that a ballistic signal may not be transferred from the detonator through the interrupter following an inadvertent detonation of the detonator.

Referring now to FIG. 1, a perforating gun or completion system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. Perforating gun system 10 includes a surface assembly 11 positioned at a wellsite 13 of system 10, and a tool string 20 deployable into wellbore 4 from a surface 5 using surface assembly 11. Surface assembly 11 may comprise any suitable surface equipment for drilling, completing, and/or operating well 20 and may include, in some embodiments, derricks, structures, pumps, electrical/mechanical well control components, etc. Tool string 20 of perforating gun system 10 may be suspended within wellbore 4 from a wireline 22 that is extendable from surface assembly 11. Wireline 22 comprises an armored cable and includes at least one electrical conductor for transmitting power and electrical signals between tool string 20 and a control system or firing panel of surface assembly 11 positioned at the surface 5.

In some embodiments, system 10 may further include suitable surface equipment for drilling, completing, and/or operating perforating gun system 10 and may include, for example, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 has a central or longitudinal axis 25 and generally includes a cable head 24, a casing collar locator (CCL) 26, a direct connect sub 28, a pair of perforating guns or tools 100A, 100B, a switch sub 200, a setting tool initiator or plug-shoot firing head (PSFH) 40, a setting tool 50, and a downhole or frac plug 60. Cable head 24 is the uppermost component of tool string 20 and includes an electrical connector for providing electrical signal and power communication between the wireline 22 and the other components (CCL 26, perforating guns 100A, 100B, switch sub 200, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12, where the transmitted signal may be recorded at surface assembly 11 as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including perforating guns 100A, 100B and associated tools, such as the setting tool 50 and downhole plug 60.

In this exemplary embodiment, a first or upper perforating gun 100A of tool string 20 is coupled to direct connect sub 28 while a second or lower perforating gun 100B of tool string 20 is coupled to switch sub 200 which is positioned between the pair of perforating guns 100A, 100B. As will be discussed further herein, perforating guns 100A, 100B are generally configured to perforate casing string 12 and provide for fluid communication between formation 6 and wellbore 4. Perforating guns 100A, 100B may be configured similarly to each other. Particularly, each perforating gun 100A, 100B includes a plurality of shaped charges that may be detonated by one or more electrical signals conveyed by the wireline 22 from the firing panel of surface assembly 11 to produce one or more explosive jets directed against casing string 12. Each perforating gun 100A, 100B may comprise a wide variety of sizes such as, for example, 2¾", 3⅛", or 3⅜", wherein the above listed size designations correspond to an outer diameter of the perforating gun 100A, 100B.

The PSFH 40 of tool string 20 is coupled to a lower end of the lower perforating gun 100B. PSFH 40 couples the perforating gun 100 of the tool string 20 to the setting tool 50 and downhole plug 60 and is generally configured to pass a signal from the wireline 22 to the setting tool 50 of tool string 20. In this embodiment, PSFH 40 also includes electrical components to fire the setting tool 50 of tool string 20.

In this embodiment, tool string 20 further includes setting tool 50 and downhole plug 60, where setting tool 50 is coupled to a lower end of PSFH 40 and is generally configured to set or install downhole plug 60 within casing string 12 to fluidically isolate desired segments of the wellbore 4. Once downhole plug 60 has been set by setting tool 50, an outer surface of downhole plug 60 seals against an inner surface of casing string 12 to restrict fluid communication through wellbore 4 across downhole plug 60. Downhole plug 60 of tool string 20 may be any suitable downhole or frac plug known in the art while still complying with the principles disclosed herein.

Figure 2:
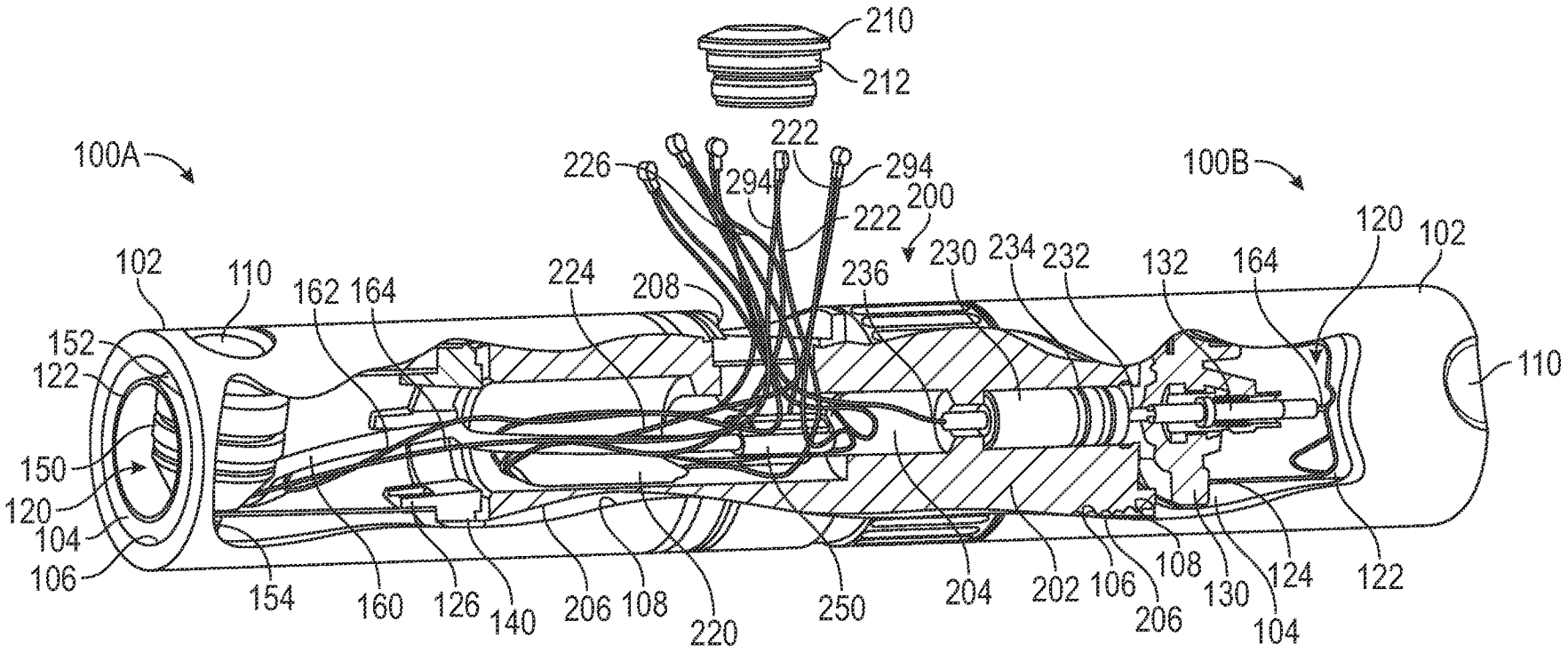
FIG. 2 is a perspective, partial cross-sectional view of an embodiment of a perforating gun of the system of FIG. 1.

Referring to FIG. 2, embodiments of the perforating guns 100A, 100B, and switch sub 200 of the tool string 20 of FIG. 1 are shown in FIG. 2. Particularly, FIG. 2 shows switch sub 200, a longitudinal first or upper end of lower perforating gun 100B, and a longitudinal second or lower end of upper perforating gun 100A. Additionally, as will be discussed further herein, FIG. 2 illustrates switch sub 200 of tool string 20 comprising an electrical switch 220 and pressure bulkhead 230. In some embodiments, electrical switch 220 may comprise a digital, addressable switch including a processor and a memory which stores an identifier unique to the addressable switch and by which the switch may be uniquely addressed by the surface assembly 11. In other embodiments, electrical switch 220 may comprise other types of electrical switches including, for example, a diode-based switch. The configuration of the electronic components of switch sub 200, including the configuration of electrical switch 220 and pressure bulkhead 230, may vary. Perforating guns 100A, 100B, and switch sub 200 share a central or longitudinal axis which is coaxial with central axis 25.

In this exemplary embodiment, each perforating gun 100A, 100B generally includes an outer sleeve or housing 102, and a charge carrier assembly 120 positionable within the outer housing 102. The outer housing 102 of each perforating gun 100A, 100B includes a central bore or passage 104 within which charge carrier assembly 120 is received. A generally cylindrical inner surface 106 defined by central passage 104 of the outer housing 102 may include a releasable or threaded connector 108 at each longitudinal end of outer housing 102. In some embodiments, a generally cylindrical outer surface of the outer housing 102 may include a plurality of circumferentially and axially spaced recesses or scallops 110 to assist with the firing of perforating gun 100A, 100B; however, in other embodiments, outer housing 102 may not include scallops 110.

The charge carrier assembly 120 of each perforating gun 100A, 100B generally includes a charge carrier 122, a first or upper endplate 130 (the upper endplate 130 of lower perforating gun 100B being shown in FIG. 2), and a second or lower endplate 140 (the lower endplate 140 of upper perforating gun 100A being shown in FIG. 2). In this exemplary embodiment, charge carrier 122 comprises a cylindrical charge tube; however, the configuration of charge carrier 122 may vary in other embodiments. The upper endplate 130 is coupled to a first or upper end 124 of charge carrier 120 while the lower endplate is coupled to a second or lower end 126 of the charge carrier 120 opposite the upper end 124. A plurality of circumferentially and axially spaced shaped charges 150 are positioned in the charge carrier 122 of each charge carrier assembly 120. Particularly, each shaped charge 150 comprising an explosive material received in a housing thereof and has a first end 152 oriented towards one of the scallops 110 of the outer housing 102, and a second end 154 opposite the first end 152. The charge carrier 122 is configured to couple with and house each shaped charge 150 and orient the first end 152 of each shaped charge 150 towards one of the scallops 110. While in this exemplary embodiment the charge carrier assembly 120 comprises a plurality of shaped charges 150, in other embodiments, charge carrier assembly 120 may include only a single shaped charge 150.

Additionally, each perforating gun 100A, 100B includes a detonating or "det" cord 160 which extends through the charge carrier 122 of the perforating gun 100A, 100B. Each shaped charge 150 is configured to initiate an explosion and emit an explosive charge from the first end 152 and through one of the scallops 110 of outer housing 102 in response to receiving a ballistic signal from the det cord 160 extending through the charge carrier 122 to which the shaped charge 150 is coupled. Particularly, the det cord 160 contacts or is otherwise ballistically coupled to the second end 154 of each shaped charge 150. In this configuration, det cord 160 of each perforating gun 100A, 100B may communicate a ballistic signal to each of the shaped charges 150 of the perforating gun 100A, 100B.

Each perforating gun 100A, 100B additionally includes a pair of electrical signal conductors or cables 162, 164 which extend through the charge carrier 122 of the perforating gun 100A, 100B. A first electrical cable 162 of the pair of electrical cables 162, 164 may be electrically connected to charge carrier 122 and may facilitate the electrical grounding of one or more components of tool string 20, as will be discussed further herein. Additionally, the upper endplate 130 of the charge carrier assembly 120 of each perforating gun 100A, 100B comprises an electrical connector 132 that is electrically connected or otherwise in signal communication with a second electrical cable 164. The lower endplate 140 of the charge carrier assembly 120 of each perforating gun 100A, 100B includes a central aperture or passage which allows for the passage of det cord 160 and electrical cables 162, 164 therethrough to components of tool string 20 positioned downhole of the perforating gun 100A, 100B.

In this exemplary embodiment, switch sub 200 of tool string 20 generally includes a cylindrical outer housing 202, an electrical switch 220, and a detonator assembly 250. The outer housing 202 of switch sub 200 includes a central bore or passage 204 within which electrical switch 220 and detonator assembly 250 are received. The outer housing 202 may include a generally cylindrical outer surface that includes a releasable or threaded connector 206 at each longitudinal end of outer housing 202. The threaded connector 206 located at a first or upper end of outer housing 202 may releasably or threadably connect with the threaded connector 108 of the outer housing 102 of upper perforating gun 100A located at the lower end of housing 102. Additionally, the threaded connector 206 located at a second or lower end of outer housing 202 may releasably or threadably connect with the threaded connector 108 of the outer housing 102 of lower perforating gun 100B located at the upper end of housing 102.

In this exemplary embodiment, the outer housing 202 of switch sub 200 may include a radial port 208 extending between cylindrical inner and outer surfaces of outer housing 202. Additionally, switch sub 200 may include a plug 210 configured to releasably or threadably couple with the radial port 208. Plug 210 comprises an annular seal assembly 212 configured to sealingly engage an inner surface of radial port 208 and thereby restrict or prevent fluid communication between the central passage 204 of outer housing 202 and the environment surrounding switch sub 200 when plug 210 is coupled to radial port 208. As will be discussed further herein, radial port 208 may be utilized by an operator of tool string 20 when assembling the components of tool string 20.

In this exemplary embodiment, in addition to electrical switch 220 and detonator assembly 250, a pressure bulkhead 230 may be positioned in the central passage 204 of the outer housing 202 of switch sub 200. Pressure bulkhead 230 comprises an electrical connector 232 configured to electrically connect with the electrical connector 132 of lower perforating gun 100B following the assembly of tool string 20. Additionally, pressure bulkhead 230 comprises a seal assembly 234 configured to sealingly engage an inner surface of the outer housing 202 of switch sub 200. Pressure bulkhead 230 may be configured to restrict or prevent the transmission of fluid pressure between lower perforating gun 100B and components of tool string 20 positioned uphole of lower perforating gun 100B, including electrical switch, detonator assembly 250, and upper perforating gun 100A. In this manner, the firing of lower perforating gun 100B may not damage or otherwise interfere with the operation of components of tool string 20 positioned uphole from lower perforating gun 100B, including switch sub 200 and upper perforating gun 100A.

Although in this embodiment the electrical switch and detonator assembly 250 are each positioned in the central passage 204 of the outer housing 202 of switch sub 200, in other embodiments, electrical switch and/or detonator assembly 250 may be positioned in other components of tool string 20. For example, in some embodiments, the electrical switch and/or detonator assembly 250 may be located in the charge carrier 122 of either upper perforating gun 100A or lower perforating gun 100B.

Figure 3:
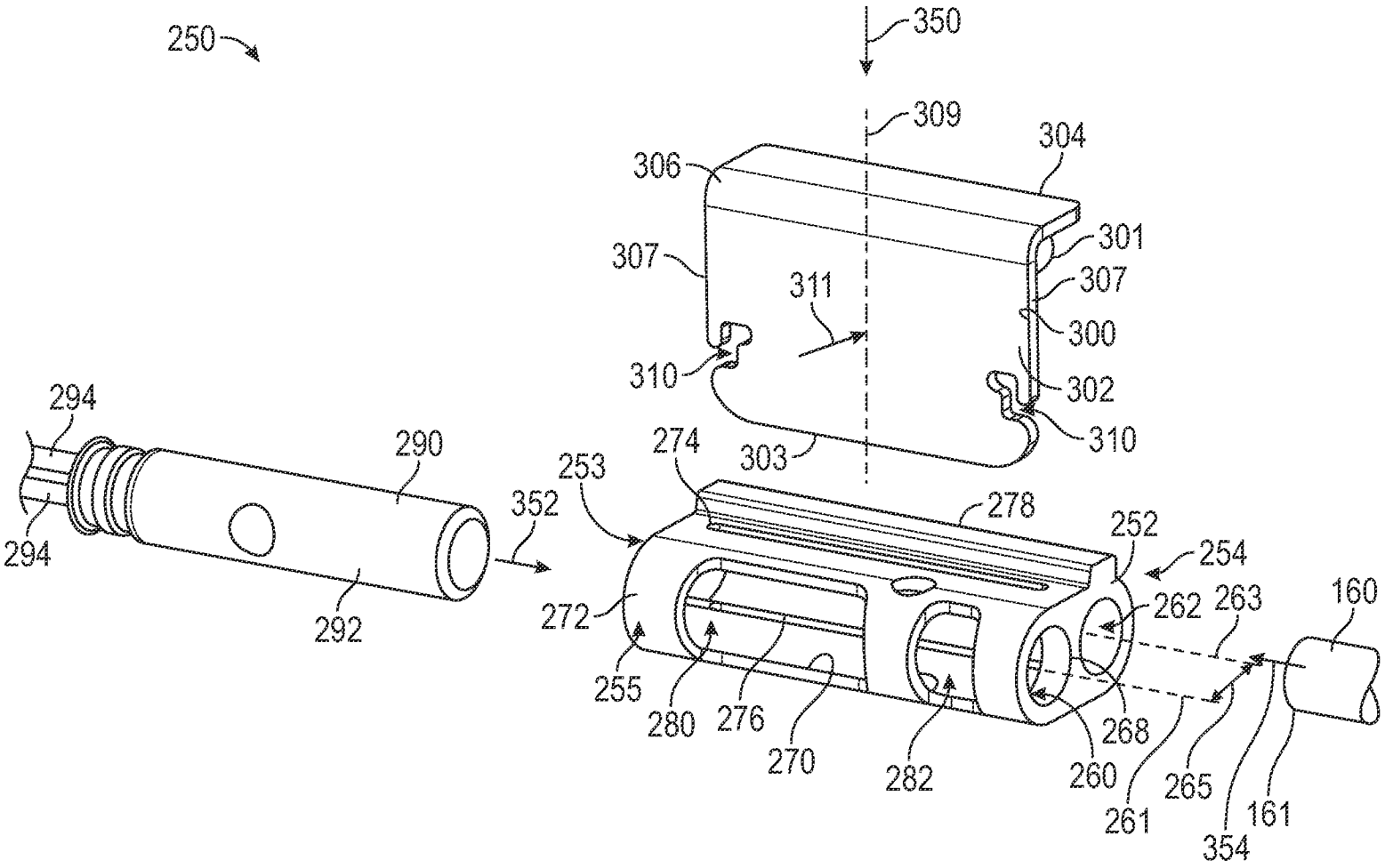
FIGS. 3-6 are perspective views of an embodiment of a detonator assembly of the perforating gun of FIG. 2.
Figure 4:
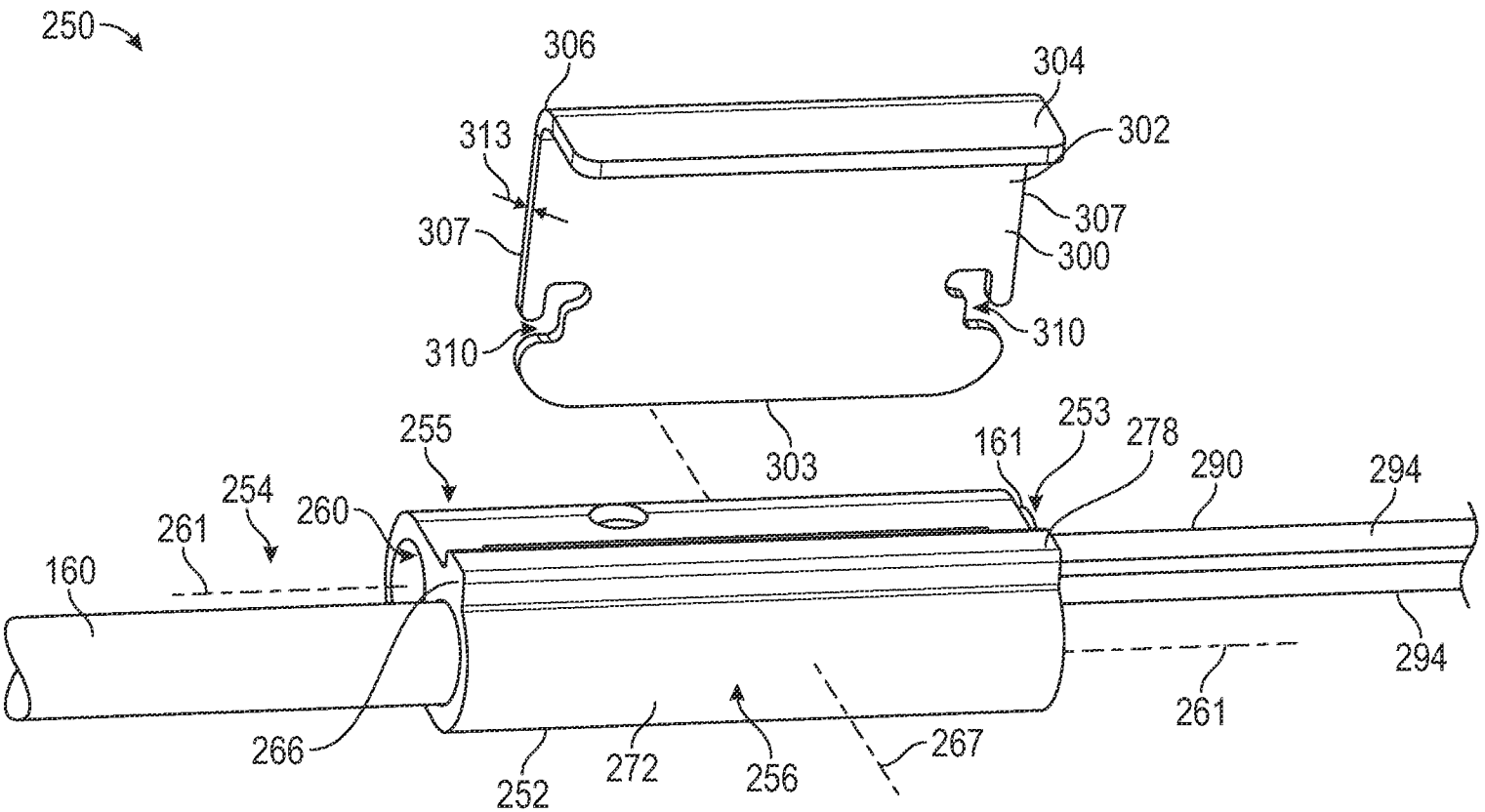
Figure 5:
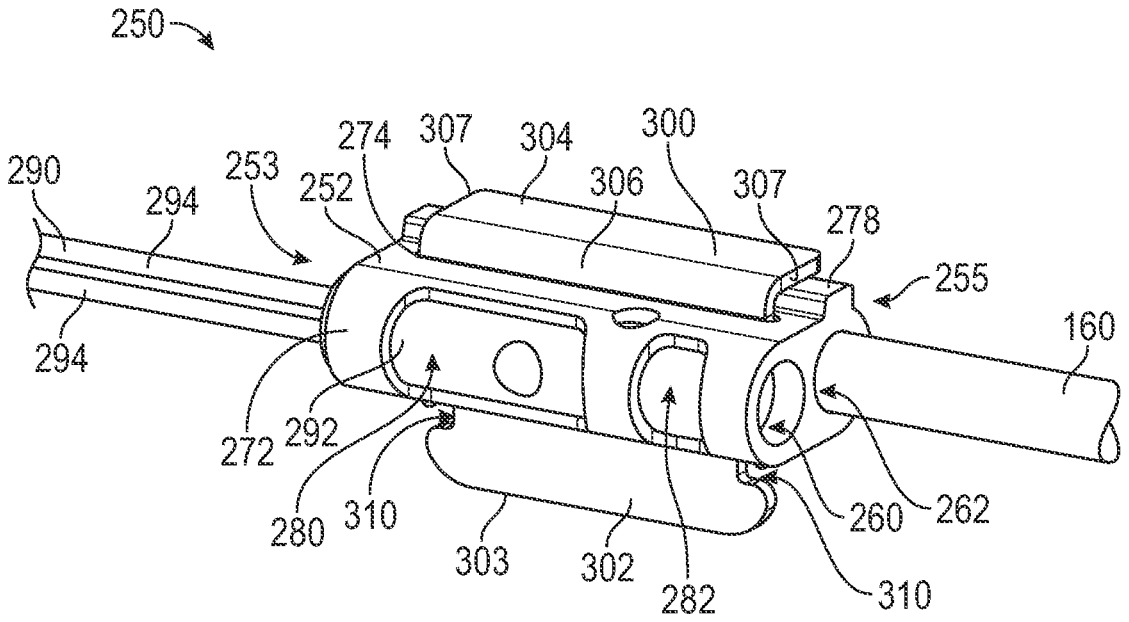
Figure 6:
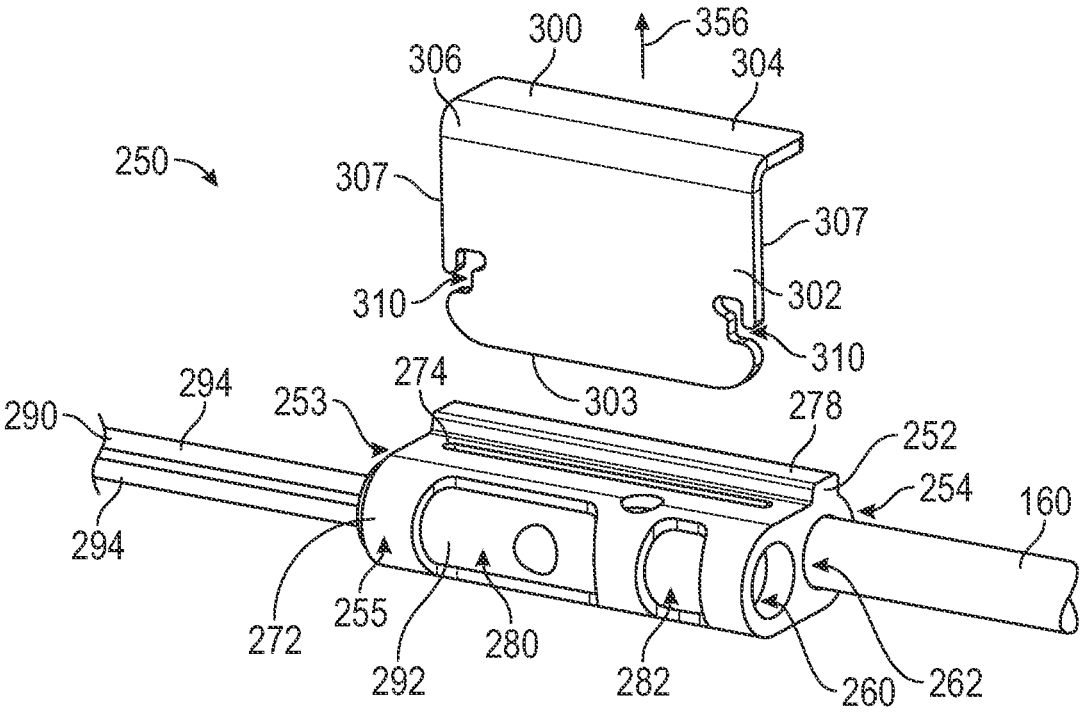
Figure 7:
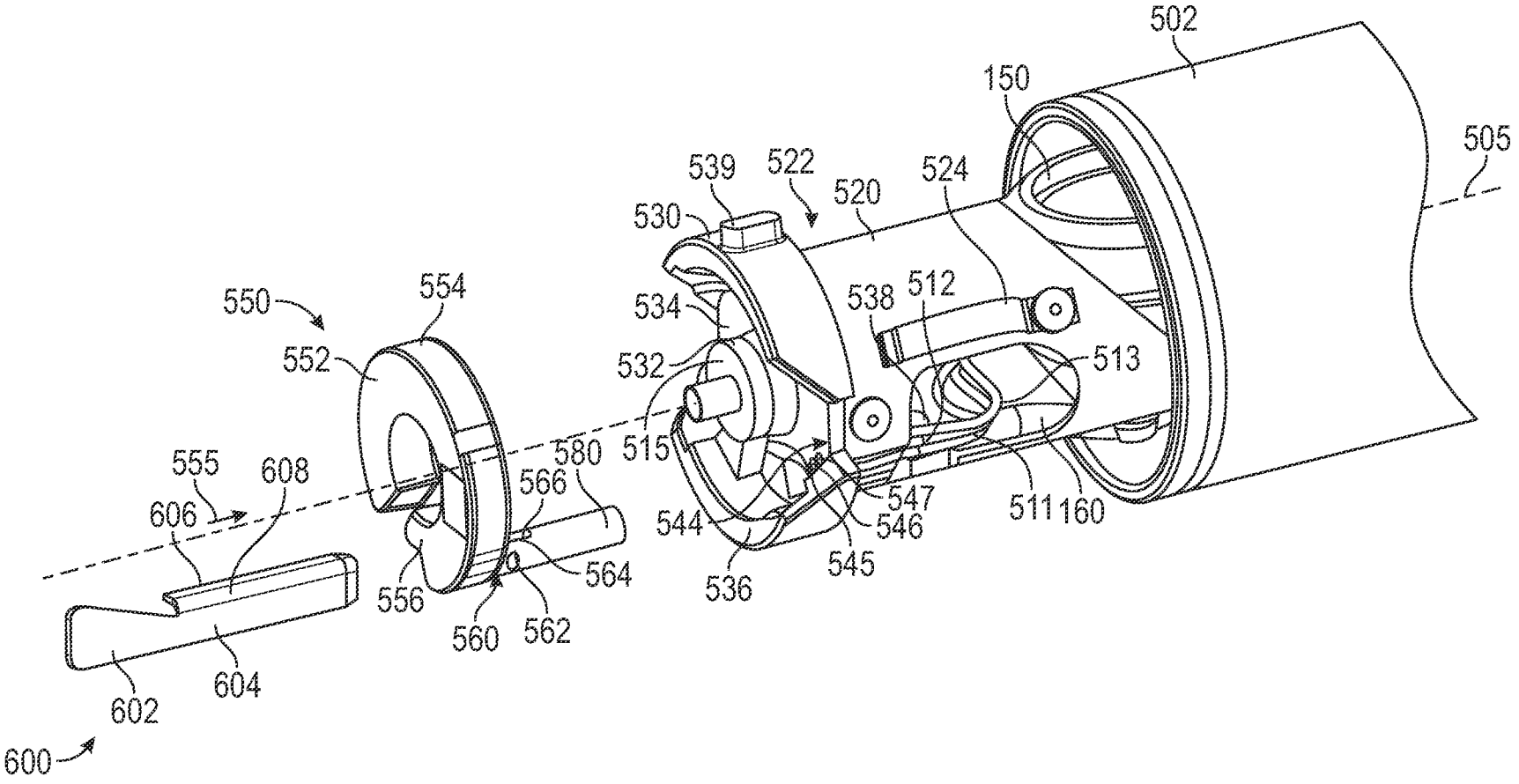
FIGS. 7, 8 are perspective views of another embodiment of a perforating gun.
Figure 8:
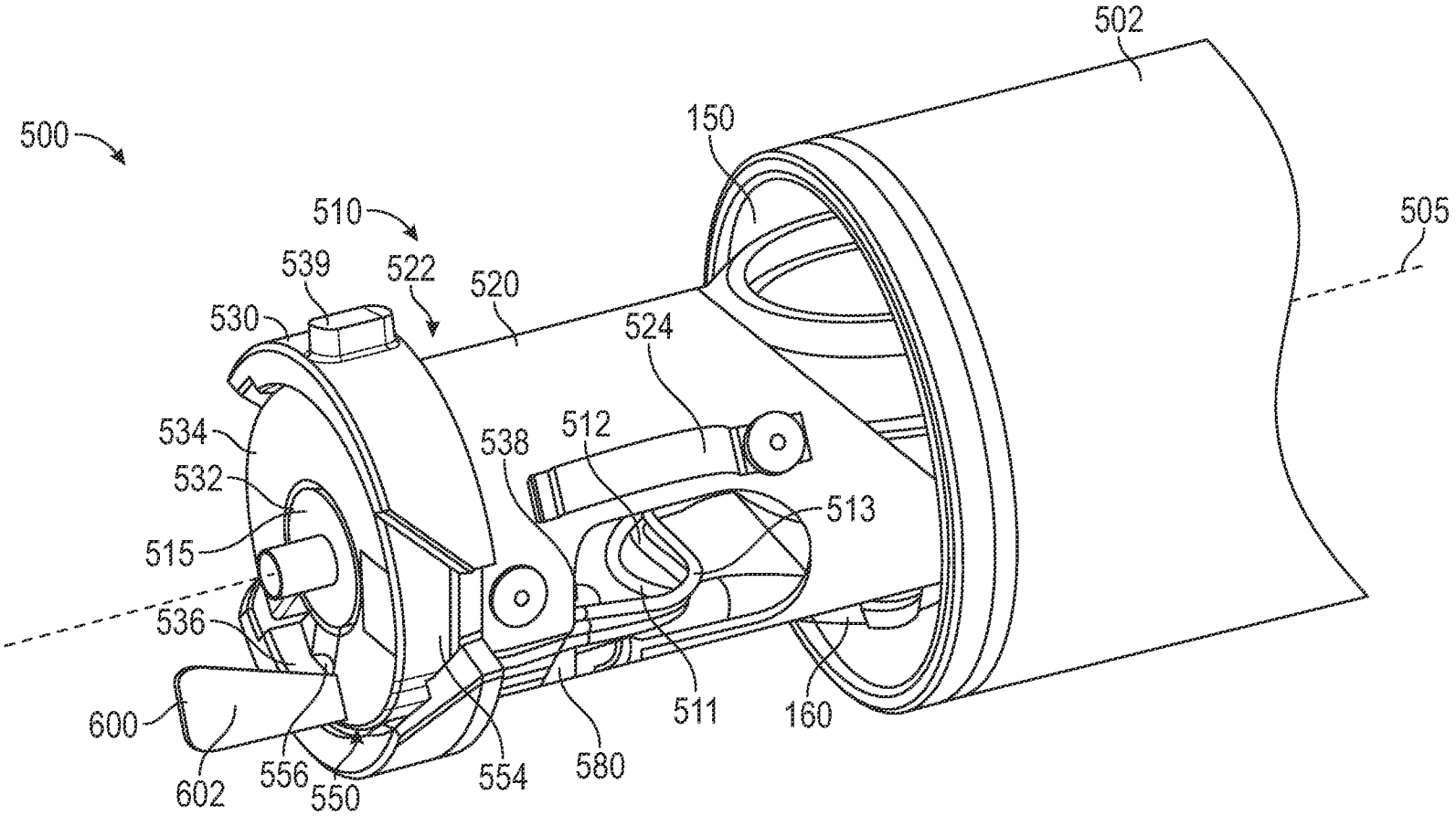
Figure 9:
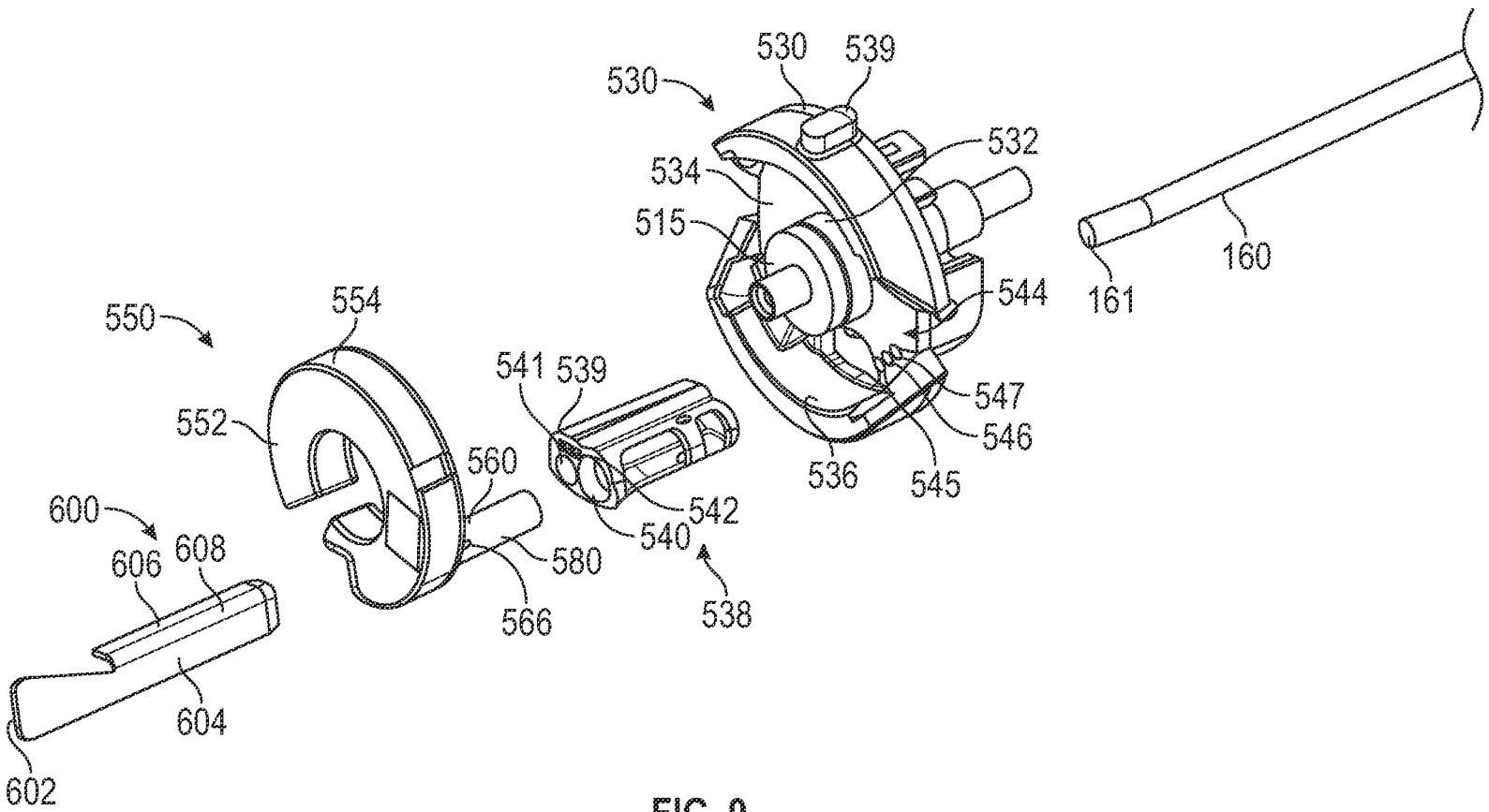
FIGS. 9, 10 are perspective views of embodiments of an endplate, an initiator assembly, and an interrupter of the perforating gun of FIGS. 7, 8.
Figure 10:
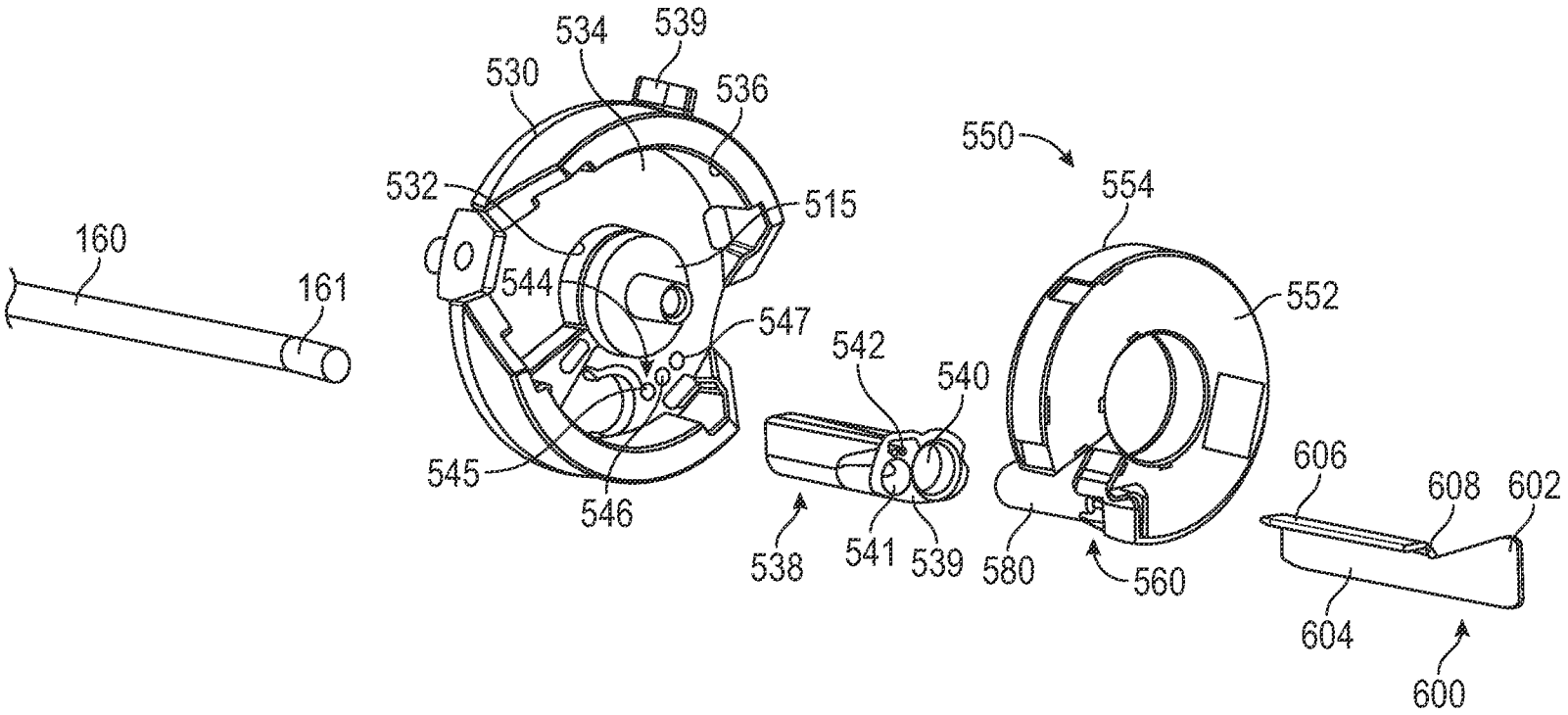

Referring to FIGS. 3, 4, the detonator assembly 250 of the switch sub 200 of FIG. 2 is shown in greater detail in FIGS. 3, 4. In this exemplary embodiment, detonator assembly 250 generally includes a detonator holder or receptacle 252, a detonator 290, and an interrupter 300. Detonator holder 252 is generally configured to at least partially receive both the detonator 290 and an end 161 of the det cord 160.

In this exemplary embodiment, detonator holder 252 has a longitudinal first end 253, a longitudinal second end 254 opposite the first end 253, and a pair of lateral sides 255, 256. Detonator holder 252 also includes a first passage 260 extending along a first longitudinal axis 261 and a second passage extending along a second longitudinal axis 263 extending parallel with but laterally offset from the first longitudinal axis 261. Each passage 260, 262 extends longitudinally through detonator holder 252 such that each passage 260, 262 extends through each longitudinal end 253, 254 of detonator holder 252. In this exemplary embodiment, passages 260, 262 are separated by a pair of walls 266, 268 located at longitudinal ends 253, 254, respectively, of detonator holder 252; however, passages 260, 262 are connected in the space extending longitudinally between walls 266, 268. In other words, in this embodiment, no structure or surface of detonator holder 252 is positioned directly between passages 260, 262 other than walls 266, 268.

A non-zero lateral spacing 265 (shown in FIG. 3) extends between the longitudinal axes 261, 263 of passages 260, 262, respectively. The lateral spacing 265 between passages 260, 262 may vary depending on the type of detonator and det cord used in the particular application as too wide of a lateral spacing 265 may inhibit the transfer of a ballistic signal from the detonator to the det cord. Thus, in some embodiments, the lateral spacing 265 may be minimized as much as possible to ensure proper functioning of detonator assembly 250 while still providing sufficient space to allow for the insertion of interrupter 300, as will be discussed further herein.

Detonator holder 252 additionally includes an internal or inner surface 270 and an external or outer surface 272 opposite inner surface 270, where at least a portion of each passage 260, 262 of detonator holder 252 may be defined by inner surface 270. In this embodiment, detonator holder 252 also includes a pair of longitudinally extending openings or slits 274, 276. Each slit 274, 276 extends entirely through detonator holder 252 from inner surface 270 to outer surface 272. Slits 274, 276 extend parallel to each other and are aligned whereby a vertical plane positioned between passages 260, 262 may extend through each slit 274, 276. In this exemplary embodiment, the longitudinal length of each slit 274, 276 is greater than 50% of the maximum longitudinal length of detonator holder 252 (maximum length of detonator holder 252 extending between ends 253, 254). In some embodiments, each slit 274, 276 may be greater than 80% of the maximum longitudinal length of detonator holder 252.

In this exemplary embodiment, the outer surface 272 of detonator holder 252 comprises a longitudinally extending raised surface or ledge 278. Ledge 278 is positioned between slit 274 and the lateral side 256 of detonator holder 252. In this embodiment, ledge 278 may extend the entire longitudinal length of detonator holder 252 between ends 253, 254; however, in other embodiments, the length of ledge 278 relative the maximum longitudinal length of detonator holder 252 may vary. Additionally, in some embodiments, detonator holder 252 may not include ledge 278.

In this exemplary embodiment, detonator holder 252 comprises a plurality of openings 280, 282, and 284 located along a first lateral side 255 of receptacle 252, where each opening 280, 282, 284 extends entirely through detonator receptacle 22 between inner surface 270 and outer surface 272. In some embodiments, openings 280, 282, 284 may have a collective length that is 50% or greater (e.g., 75%, etc.) of the maximum longitudinal length of detonator holder 252 (maximum length of detonator holder 252 extending between ends 253, 254). Openings 280, 282, and 284 are positioned directly adjacent first passage 260 and thus may provide for communication (e.g., fluid communication for fluid disabled detonators) between first passage 260 and the environment surrounding detonator holder 252. Additionally, openings 280, 282, and 284 may form a region of reduced strength in detonator holder 252 whereby, in the event of an inadvertent detonation of detonator 290 with interrupter 300 installed in detonator holder 252, the amount of force imparted to interrupter 300 is minimized as openings 280, 282, and 284 create a path of least resistance defined by the region of reduced strength and which may be torn apart by the explosive gasses generated by the initiation of detonator 290, thereby permitting the venting of the explosive gasses from first passage 260 in a direction extending away from second passage 262 and det cord 160. Additionally, while in this embodiment detonator holder 252 includes openings 280, 282, and 284; in other embodiments, receptacle 252 may not include opening 280 and/or opening 282, and 284 depending on the configuration of detonator 290 and det cord 160.

Detonator 290 of detonator assembly 250 is generally configured to convert an electrical signal into a ballistic signal which may be communicated to the det cord 160 and thereby fire the shaped charges 150 of at least one perforating gun 100A, 100B. In this exemplary embodiment, detonator 290 generally includes a housing 292 in which explosive or combustible material (not shown in FIGS. 3, 4) is stored, and a pair of electrical signal conductors or cables 294 extending from the housing 292. The combustible material housed within the housing 292 of detonator 290 may be fired or detonated in response to an electrical signal conducted to housing 292 via electrical cables 294.

As shown particularly in FIG. 4, following the assembly of detonator assembly 250, the housing 292 of detonator 290 is received within first passage 260 of detonator holder 252 while the end 161 of det cord 160 is received within second passage 262 of receptacle 252. Particularly, following the assembly of detonator assembly 250, the housing 292 of detonator 290 may be oriented parallel with, but offset from (by the lateral spacing 265) the portion of det cord 160 received within the second passage 262 of detonator holder 252. Additionally, in some embodiments, a lateral axis 267 oriented orthogonal axes 261, 263 may intersect and extend through both the housing 292 of detonator 290 and det cord 160. Thus, housing 292 of detonator 290 and at least a portion of det cord 160 may be positioned side-by-side in a "side fire" configuration.

Once received in the passages 260, 262 of detonator holder 252, detonator 290 is positioned within sufficient proximity of det cord 160 such that det cord 160 may ballistically couple with detonator 290. In other words, with detonator 290 received in first passage 260 and det cord 160 received in second passage 262, detonation of detonator 290 may result in the transmission of a ballistic signal to det cord 160 which may be conveyed to the shaped charges 150 of at least one of the perforating guns 100A, 100B.

As described above, in some conventional perforating gun systems, the detonator of the perforating gun may only be assembled once the perforating gun has been transported to the wellsite to ensure that one or more shaped charges of the conventional perforating gun system do not inadvertently detonate prior to the perforating gun being injected into the wellbore (e.g., during transport of the perforating gun to the wellsite). Particularly, in order to avoid the possibility of an inadvertent detonation, the detonator of some conventional perforating gun systems may be assembled or placed in proximity with a det cord only when the conventional perforating gun system is located at the wellsite. Thus, in at least some conventional perforating gun systems, the detonator assembly of the perforating gun may only be assembled (e.g., placing a detonator of the detonator assembly within proximity of a det cord whereby a ballistic signal may be communicated from the detonator to the det cord) following the transportation of the perforating gun system to the wellsite.

As will be described further herein, interrupter 300 of detonator assembly 250 may permit for the assembly of detonator assembly 250 at a location remote of wellsite 13 (e.g., a central location where a large number of perforating guns 100A, 100B and switch subs 200 are assembled) such that the assembled detonator assembly 250 may be safely transported from the remote location to the wellsite 13 without the risk of an inadvertent detonation of one or more shaped charges 150. In other words, interrupter 300 may safely allow for detonator 290 of detonator assembly 250 to be placed in proximity of det cord 160 (e.g., a distance sufficiently small to allow for the communication of a ballistic signal between the detonator 290 and det cord 160) at a remote location and transported to wellsite 13 in an assembled configuration. In this manner, detonator assembly 250 need not be assembled at the wellsite 13, thereby reducing the amount of time required for assembling tool string 20 and for performing a perforating operation using tool string 20. By minimizing the time required for performing the perforating operation, the total costs associated with performing the perforating operation may in-turn be minimized.

Interrupter 300 of detonator assembly 250 is generally configured to prevent the ballistic coupling of detonator 290 and det cord 160 even when detonator 290 is positioned in first passage 260 of detonator holder 252 and det cord 160 is positioned in second passage 262 of receptacle 252 such that lateral axis 267 intersects both detonator 290 and det cord 160. In other words, interrupter 300 is configured to prevent or block the detonation of any shaped charge 150 ballistically coupled to det cord 160 following an inadvertent detonation of the detonator 290 of detonator assembly. Interrupter 300 may be inserted through at least one of 274, 276 of detonator holder 252 such that at least a portion of interrupter 300 is positioned directly and laterally between detonator 290 and det cord 160 whereby lateral axis 267 intersects interrupter 300 along with detonator 290 and det cord 160. When interrupter 300 is positioned within detonator holder 252 between detonator 290 and det cord 160, interrupter 300 may interrupt or block the transmission of a ballistic signal from detonator 290 to det cord 160 in the event of an inadvertent detonation of detonator 290.

In this embodiment, interrupter 300 generally includes a first planar member or plate 302, a second planar member or plate 304 extending at a non-zero, non-180-degree angle 301 (shown in FIG. 3) relative to the first plate 302, thereby forming a bend 306 extending between first plate 302 and second plate 304. In some embodiments, angle 301 may range approximately between 60 degrees and 120 degrees. In some embodiments, angle 301 may range approximately between 80 degrees and 110 degrees. In certain embodiments, angle 301 may be approximately 90 degrees. However, the magnitude of angle 301 may vary in still other embodiments. Bend 306 formed between plates 302, 304 may increase a bending resistance of interrupter 300 and/or otherwise increase a strength or resistance to deformation of interrupter 300.

Particularly, bend 306 may increase a resistance of interrupter 300 to bending of lateral edges 307 of interrupter 300 about a deformation axis 309 which may be co-planar with a plane extending through first plate 302. Deformation axis 309 may extend orthogonally relative axes 261, 263 of the passages 260, 262, respectively, of detonator holder 252 when interrupter 300 is received within detonator holder 252. For instance, a force (indicated by arrow 311 in FIG. 3) orthogonally directed at the first plate 302 may apply a bending moment interrupter 300 about deformation axis 309 when interrupter 300 is received within detonator holder 252. For instance, the detonation of detonator 290 within first passage 260 of detonator holder 252 may result in the application of orthogonal force 311 against the first plate 302 of interrupter 300, and the application of orthogonal force 311 may act to bend or deform first plate 302 in the direction of the portion of det cord 160 positioned in second passage 262 of detonator holder 252. Thus, in order to the block the transmission of a ballistic signal from detonator 290 to det cord 160, interrupter 300 must resist sufficiently resist deformation resulting from the detonation of detonator 290 (which results in the application of orthogonal force 311) such that first plate 302 of interrupter 300 is not physically pierced or penetrated by detonator 290.

Second plate 304 of interrupter 300, being positioned at angle 301 from first plate 302, may increase the resistance of interrupter 300 against orthogonal force 311 such that interrupter 300 is not penetrated by the detonation of detonator 290. Particularly, the application of orthogonal force 311 against the first plate 302 of interrupter 300 may result in a tensile or compressive force (depending on the direction of orthogonal force 311) being applied to second plate 304 of interrupter 300. Second plate 304 may act to resist the tensile or compressive force applied thereto in response to the application of orthogonal force 311 against first plate 302. The resistance of second plate 304 to tension/compression may thereby increase the resistance of interrupter 300 with respect to deformation of first plate 302 about deformation axis 309, and thus increase the resistance of interrupter 300 to deformation resulting from the detonation of detonator 290.

Given that second plate 304 increases the resistance of interrupter 300 to deformation resulting from the detonation of detonator 290, a thickness 313 (shown in FIG. 4) of the first plate 302 of interrupter 300 may be minimized while at the same time ensuring that interrupter 300 will serve to block the transmission of a ballistic signal from detonator 290 to det cord 160 following an inadvertent detonation of detonator 290. Thickness 313 of the first plate 302 may be greater than a maximum length of first plate 302 (e.g., a maximum length extending between lateral sides 307). By minimizing the thickness 313 of interrupter 300, the distance between detonator 290 and det cord 160 (e.g., lateral spacing 265 between passages 260, 262 of detonator holder 252) may in-turn be minimized, ensuring that detonator 290, following an intentional detonation with interrupter 300 removed from detonator holder 252, will successfully communicate a ballistic signal to det cord 160 whereby the shaped charges 150 of at least one of perforating guns 100A, 100B will be fired.

In this embodiment, plates 302, 304 are formed integrally or monolithically with each other; however, in other embodiments, plates 302, 304 may comprise separate components that are coupled (e.g., welded) together prior to the assembly of detonator assembly 250. In this embodiment, a pair of recesses 310 are formed proximal a terminal end 303 of the first plate 302 along lateral edges 307 of interrupter 300. As will be discussed further herein, recesses 310 may receive a retainer (not shown in FIGS. 3, 4) for securing interrupter 300 to detonator holder 252 when interrupter 300 is positioned within detonator holder 252. In some embodiments, interrupter 300 may not include recesses 310.

In some embodiments, interrupter 300 (including each plate 302, 304) may be formed from or comprise an alloy steel such as 4130 or 4140 alloy steel; however, in other embodiments, interrupter 300 may comprise other alloys such as a high strength stainless steel. In embodiments where interrupter 300 comprises a monolithically formed member, interrupter 300 may be formed from a single planar member or plate which is bent to form an L-shape including plates 302, 304 and the bend 306 extending therebetween. For example, interrupter 300 may be formed from a single piece of material that is either punched or pressed from a coiled raw material. Alternatively, interrupter 300 may be formed by laser cutting a piece of material from a sheet of material and then subsequently pressing the cut piece of material into the form of interrupter 300. In other embodiments, the process used to form interrupter 300 may vary from the exemplary processes described herein.

Referring now to FIGS. 7-10, another embodiment of a perforating gun 500 is shown. The embodiment of perforating gun 500 shown in FIGS. 7-10 may include features in common with perforating guns 100A, 100B shown in FIGS. 2-5, and shared features are labeled similarly. In this embodiment, perforating gun 500 has a central or longitudinal axis 505 and may generally include outer housing 502, and a charge carrier assembly 510 positionable within the outer housing 502. Outer housing 502 may be similar in configuration to outer housing 102 of perforating guns 100A, 100B and thus is not described in detail herein.

As with charge carrier assembly 120 shown in FIG. 2, charge carrier assembly 510 of perforating gun 500 may be generally configured to detonate one or more shaped charges 150 in response to receiving a firing signal (e.g., from surface assembly 11). In this embodiment, charge carrier assembly 510 generally includes a charge carrier 520, a first or upper endplate (not shown in FIGS. 7-10), a second or lower endplate 530, and an initiator assembly 550. The lower endplate 530 is coupled to a first or lower end 522 of charge carrier 520 while the lower endplate is coupled to a second or upper end (not shown in FIGS. 7-10) of the charge carrier 520 opposite the lower end 522. Although not shown in FIGS. 7-10, in some embodiments, the upper endplate of charge carrier assembly 510 may be similar in configuration as the upper endplate 130 of the charge carrier assembly 120 shown in FIG. 2. Charge carrier 520 may also include a contact or ground spring 524 which extends radially outwards from charge carrier 520 and contacts an inner cylindrical surface of outer housing 502 to electrically ground the initiator assembly 550 of perforating gun 500. Similar in configuration to charge carrier 122 shown in FIG. 2, one or more spaced shaped charges 150 are positioned in the charge carrier 520. Charge carrier assembly 510 includes det cord 160 extending through charge carrier 520 and ballistically coupled to each shaped charge 150.

In this exemplary embodiment, initiator assembly 550 includes an electrical switch 560 (e.g., a digital addressable switch, a diode-based switch, etc.) and a detonator 580. Unlike the perforating guns 100A, 100B described above each of which include an electrical switch and a separate detonator assembly 250 located external of the perforating gun 100A, 100B (e.g., within switch sub 200, etc.), in this exemplary embodiment, initiator assembly 550 of perforating gun 500 is configured to directly connect with lower endplate 530 of charge carrier 520 and to be received within the outer housing 502. Thus, in this embodiment, switch 560 and detonator 580 are integrated into a single electronic initiator assembly 550 which is receivable within outer housing 502, eliminating the need for a separate sub, such as switch sub 200, for receiving initiator assembly 550. By eliminating the need for additional subs to receive components of initiator assembly 550, an overall longitudinal length of a tool string comprising perforating gun 500 may be minimized. In still other embodiments, initiator assembly 550 may be located within an interior of charge carrier 520.

In this exemplary embodiment, lower endplate 530 generally includes a central passage 532 aligned with the central axis 505 of perforating gun 500, an annular member 534 extending entirely about the central axis 505, an arcuate initiator receptacle 536 extending at least partially about central axis 505, a detonator holder 538 extending from the annular member 534 and through the charge carrier 520 of charge carrier assembly 510, and a multi-contact electrical connector 544 formed in annular member 534. Detonator holder 538 may be positioned differently in other embodiments. For example, in some embodiments, detonator holder 538 may be loosely positioned within the interior of charge carrier 520. Initiator receptacle 546 may receive the initiator assembly 550 of perforating gun 500 and may comprise one or more surface features to allow for the coupling of initiator assembly 550 with lower endplate 530 whereby relative movement between initiator assembly 550 and lower endplate 530 is restricted.

Detonator holder 538 provides ballistic signal connectivity between the detonator 580 of initiator assembly 550 and the det cord 160 of perforating gun 500. Detonator holder 538 may be configured similarly as, and may share features in common with, detonator holder 252 shown in FIGS. 3-6. As shown particularly in FIGS. 9, 10, in some embodiments, detonator holder 538 may comprise a first end 539 configured to couple with annular member 534, a longitudinal first or detonator passage 540, and a longitudinal second or cord passage 541. Passages 540, 541 each extend parallel with, but are radially or laterally offset from, central axis 505 of perforating gun 500. Detonator passage 540 is configured to receive the detonator 580 of initiator assembly 550 when assembly 550 is coupled to lower endplate 530 while cord passage 541 is configured to receive the det cord 160 ballistically coupled to the shaped charges 150 of perforating gun 500.

In this exemplary embodiment, detonator holder 538 includes an L-shaped interrupter receptacle or slot 542 positioned directly between passages 540, 541. Interrupter slot 542 may receive an interrupter 600 of perforating gun 500. Similar to interrupter 300 shown in FIGS. 3-6, interrupter 600 is generally configured to interrupt or block the transmission of a ballistic signal from detonator 580 to det cord 160 in the event of an inadvertent detonation of detonator 580.

In this exemplary embodiment, interrupter 600 generally includes a tab or handle 602, a first plate 604 that is co-planar with handle 602, a second plate 606 extending at a non-zero angle (e.g., an angle extending approximately between 60 degrees and 120 degrees) relative to first plate 604 and which forms a bend 608 extending between plates 604, 606. When interrupter 600 is received in interrupter slot 542, first plate 604 may be positioned circumferentially between passages 540, 541 of detonator holder 538 while second plate 606 may be positioned radially between cord receptacle 541 and central axis 505 of perforating gun 500. Similar to bend 306 of interrupter 300, bend 608 may increase a resistance of interrupter 600 to bending of interrupter 600 about a deformation axis that is co-planar with first plate 604 of interrupter 600. However, in other embodiments, the configuration of interrupter 600 may vary.

Electrical connector 544 of lower endplate 530 may provide electrical signal connectivity between initiator assembly 550 and components of the tool string comprising perforating gun 500 located both uphole and downhole from gun 500. In this embodiment, electrical connector 544 may include a plurality of female electrical contacts or receptacles 545, 546, and 547, respectively. Prior to assembly of perforating gun 500, female electrical contacts 545, 546, and 547 may be electrically connected or wired to signal conductors or electrical cables 511, 512, and 513, respectively.

In some embodiments, electrical cable 511 may be electrically connected with the contact spring 524 of charge carrier 520; electrical cable 512 may be electrically connected with an electrical connector 515 received within the central passage 532 of lower endplate 530, where electrical connector 515 is connected or secured to lower endplate 530. Electrical connector 515 may be electrically connected or otherwise in signal communication with downhole tools positioned uphole from perforating gun 500 whereby signals transmitted downhole from the surface to perforating gun 500 are first received by electrical connector 515 prior to being forwarded to initiator assembly 550. Thus, electrical cable 512, which is directly connected to electrical connector 515, may comprise a line-in of perforating gun 500.

Electrical cable 513 may be in signal communication with downhole tools positioned downhole from perforating gun 500, such as a setting tool (e.g., setting tool 50 shown in FIG. 1). Thus, electrical cable 513 may comprise a line-out of perforating gun 500. In some embodiments, electrical cable 513 may be electrically connected or otherwise in signal communication with an electrical connector (not shown in FIGS. 7-10) coupled to the upper endplate of charge carrier assembly 510. In some embodiments, the electrical connector coupled to electrical cable 513 may be similar in configuration as electrical connector 515. In other embodiments, electrical cable 513 may extend from outer housing 502 to a sub positioned directly downhole from perforating gun 500.

In this exemplary embodiment, initiator assembly 550 of perforating gun 500 controls the operation of perforating gun 500, including the detonation of shaped charges 150, in response to the transmission of one or more signals to perforating gun 500 from the surface (e.g., from assembly 11 shown in FIG. 1). In some embodiments, initiator assembly 550 may generally comprise an arcuate outer housing 552, switch 560, and detonator 580. Switch 560 may be received within outer housing 552, where outer housing 552 may have a radially outer surface 554 comprising one or more surface features configured to couple (e.g., releasably couple) with the initiator receptacle 536 of the lower endplate 530. In some embodiments, housing 552 may be slidably connected with initiator receptacle 536 of lower endplate 530. In certain embodiments, a snap-fit may be formed between housing 552 of initiator assembly 550 and initiator receptacle 536 of lower endplate 530. Switch 560 of initiator assembly 550 may be received within housing 552 and may be radially offset from central axis 505 of perforating gun 500. Particularly, switch 560 may extend arcuately about central axis 505 and electrical connector 515.

In some embodiments, switch 560 may comprise a plurality of electrical male contacts 562, 564, and 566, each extending through apertures formed in housing 552. Each male contact 562, 564, and 566 of switch 560 may be slidably received in a corresponding female contact 545, 546, and 547 of electrical connector 544 in response to the coupling of initiator assembly 550 with lower endplate 530. Particularly, in response to the coupling of initiator assembly 550 with lower endplate 530, an electrical connection may be formed between switch 560 and electrical cables 511, 512, and 513 of perforating gun 500. Thus, switch 560 does not need to be wired to cables 511, 512, and 513, and instead, initiator assembly 550 need only be slid or snapped into lower endplate 530 to form an electrical connection between switch 560 and electrical cables 511, 512, and 513.

Detonator 580 may be rigidly coupled or affixed (e.g., soldered, etc.) to a printed circuit board (PCB) of switch 560 whereby relative movement between detonator 580 and switch 560 is restricted. Detonator 580 may be slidably received in the detonator passage 540 of detonator holder 538 as the initiator assembly 550 is slid or snapped into lower endplate 530, thereby placing detonator 580 into proximity with det cord 160 (received in cord passage 541 of detonator holder 538) whereby a ballistic signal may be transmitted from detonator 580 to det cord 160 when interrupter 600 is not positioned in the interrupter slot 542 of detonator holder 538. In other words, when interrupter 600 is not present within interrupter slot 542, the detonation of detonator 580 (initiated by switch 560 in response to switch 560 receiving a firing signal from the surface) may result in the detonation of shaped charges 150 of perforating gun 500. Conversely, when interrupter 600 is present within interrupter slot 542, the detonation of detonator 580 does not result in the detonation of any of the shaped charges 150 of perforating gun 500 due to interrupter 600 blocking the ballistic signal transmitted from detonator 580 (following the detonation thereof) towards det cord 160. Thus, following the coupling of initiator assembly 550 with the lower endplate 530 of charge carrier assembly 510, interrupter 600 may be removed from interrupter slot 542 to arm perforating gun 500 whereby a firing signal transmitted to the switch 560 of initiator assembly 550 may cause the detonation of one or more shaped charges 150 of perforating gun 500.

In some embodiments, at least some components of perforating gun 500 may be assembled at a remote location distal the wellsite prior to transporting perforating gun 500 to the wellsite for performing a perforating operation. For example, at a remote location (e.g., a central location or facility used to manufacture one or more perforating guns 500) charge carrier assembly 510 may be assembled by coupling electrical connector 515 with lower endplate 530 and wiring electrical cables 511, 512, and 513 with female contacts 545, 546, and 547, respectively. Additionally, electrical cable 511 may be connected to contact spring 524 and electrical cable 513 may be connected to an electrical connector coupled to the upper endplate of charge carrier assembly 510. Further, one or more of the shaped charges 150 may be coupled to charge carrier 520, det cord 160 may be ballistically coupled to each shaped charge 150 and an end (e.g., end 161) of det cord 160 may be inserted into cord passage 541, and the lower endplate 530 and the upper endplate of charge carrier assembly 510 may be coupled to charge carrier 520 to complete the assembly of charge carrier assembly 510. At the remote location, charge carrier assembly 510 may be inserted into outer housing 502 of perforating gun 500. In some embodiments, a radially extending tab 539 of lower endplate 530 may be received in a groove formed in the inner surface of housing 502 to orient charge carrier assembly 510 within housing 502.

At the remote location, following the insertion of charge carrier assembly 510 into outer housing 502, interrupter 600 may be inserted manually into a slot 556 formed in the housing 552 of initiator assembly 550, and initiator assembly 550, including interrupter 600 coupled thereto, may be coupled to lower endplate 530 whereby interrupter 600 is inserted into the interrupter slot 542 of lower endplate 530, preventing a ballistic connection from forming with the det cord 160 positioned in the cord passage 541 of lower endplate 530. In other embodiments, interrupter 600 may first be inserted into interrupter slot 542, followed by the insertion of initiator assembly 550 (which may also be pre-assembled at a location remote from the wellsite) along an insertion axis 555 (shown in FIG. 7) which is co-axial with a central or longitudinal axis of charge carrier assembly 510 into the initiator receptacle 536 of lower endplate 530 whereby male contacts 560, 562, and 564 are slidably inserted into the female contacts 545, 546, and 547, respectively, of charge carrier assembly 510 and an electrical connection is formed between the switch 560 of initiator assembly 550 and the electrical cables 511, 512, and 513 of charge carrier assembly 510. In some embodiments, initiator assembly 550 may be snapped into initiator receptacle 536 forming a snap fit therebetween; however, in other embodiments, other features or mechanisms for retaining initiator assembly 550 with lower endplate 530 may be employed such as fasteners and the like. Following the coupling of initiator assembly 550 with lower endplate 530, endcaps (not shown in FIGS. 7-10) may be coupled to the ends of housing 502 and the now assembled perforating gun 500 may be transported from the remote location to the wellsite (e.g., wellsite 13) for assembly with the other components of the tool string (e.g., tool string 20) comprising perforating gun 500.

At the wellsite, prior to being assembled with the tool string, the endcaps may be removed from housing 502 and interrupter 600 may be manually removed (e.g., via handle 602) from the interrupter slot 542 of lower endplate 530, thereby arming perforating gun 500 such that a ballistic connection is formed between the detonator 580 of initiator assembly 550 and the det cord 160 ballistically coupled to the one or more shaped charges 150 of perforating gun 500. The outer housing 502 of perforating gun 500 may then be coupled (e.g., threadably coupled) to components of the tool string and the assembled tool string may be lowered into a wellbore (e.g., wellbore 4) along a wireline (e.g., wireline 22) that is in signal communication with switch 560 of initiator assembly 550. Once perforating gun 500 is positioned at a desired location in the wellbore, one or more signals may be transmitted from the surface (e.g., from surface assembly 11) to the switch 560 of perforating gun 500 to detonate the one or more shaped charges 150 of perforating gun 500.

Figure 11:
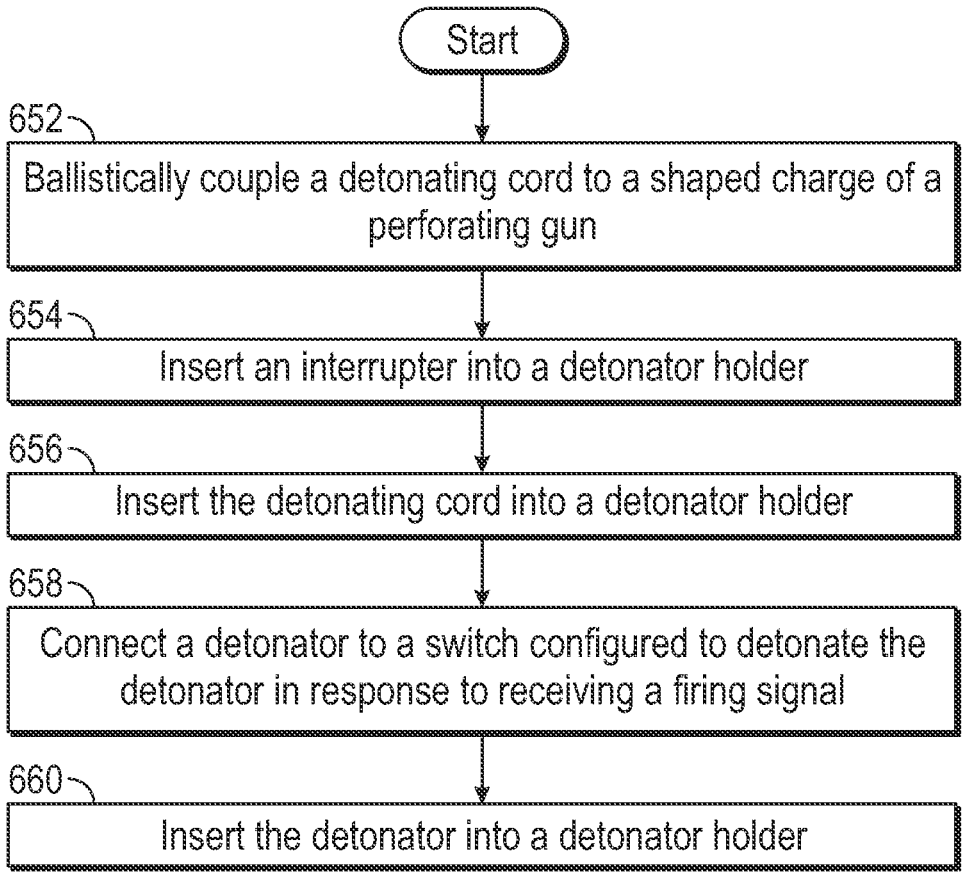
FIG. 11 is a flowchart of an embodiment of a method for assembling a detonator assembly of a perforating gun system.

Referring to FIG. 11, a flowchart of a method 650 of assembling a perforating gun system is shown. In some embodiments, method 650 may be practiced with one or more components of tool string 20 (e.g., perforating guns 100A, 100B, switch sub 200, etc.) shown in FIGS. 1, 2, as well as the perforating gun 500 shown in FIGS. 7-10. Thus, in describing the features of method 650, continuing reference will be made to tool string 20 shown in FIGS. 1, 2, and 7-10; however, it should be appreciated that embodiments of method 650 may be practiced with other devices.

Initially, method 650 includes ballistically coupling a detonating or det cord to a shaped charge of a perforating gun at block 652. In some embodiments, block 652 may comprise coupling det cord 160 to one of the shaped charges 150 of one of the perforating guns 100A, 100B of tool string 20 shown particularly in FIG. 2, and/or coupling det cord 160 to one of the shaped charges 150 of perforating gun 500 shown in FIGS. 7-10. For example, det cord 160 may be positioned within a connector or fork located at the second end 154 of one of the shaped charges 150 to ballistically couple det cord 160 with the shaped charge 150. Shaped charges 150 may be coupled to a charge carrier (e.g., charge carriers 122, 520) prior to the coupling of det cord 160 with the shaped charges 150. Following the ballistic coupling of det cord 160 with the shaped charge 150, the shaped charge 150 may be fired or detonated in response to receiving a ballistic signal communicated to the shaped charge 150 from the det cord 160.

Method 650 continues at block 654 by inserting an interrupter into the detonator holder at block 654. In some embodiments, block 654 comprises inserting interrupter 300 into the detonator holder 252 of detonator assembly shown particularly in FIGS. 3-6. For example, the terminal end 303 of the first plate 302 of interrupter 300 may be manually inserted (the direction of travel of interrupter 300 is indicated by arrow 350 in FIG. 3) through first the first slit 274 and then the second slit 276 of detonator holder 252 until the second plate 304 of interrupter 300 contacts or is positioned directly adjacent the ledge 278 of detonator holder 252.

Method 650 continues at block 656 by inserting the det cord into a detonator holder. In some embodiments, block 656 comprises manually inserting a terminal end of the det cord into a passage formed in the detonator holder. For example, block 656 may comprise manually inserting the terminal end 161 of det cord 160 into and through the second passage 262 (an exemplary direction of travel of det cord 160 is indicated by arrow 354 in FIG. 3; however, det cord 160 may be inserted into second passage 262 from either longitudinal end thereof) of detonator holder 252. In certain embodiments, block 656 may comprise inserting the terminal end 161 of det cord 160 into the cord passage 541 of the lower endplate 530 of perforating gun 500.

With interrupter 300 extending entirely through detonator holder 252, interrupter 300 is disposed in an inserted position. In some embodiments, first plate 302 extends entirely through detonator holder 252 with terminal end 303 positioned external detonator holder 252 when interrupter 300 is in the inserted position. Following the insertion of interrupter 300 through detonator holder 252, an annular retainer may be positioned about the terminal end 303 of first plate 302 and received within recesses 310 to couple the retainer with interrupter 300 and thereby secure or lock interrupter 300 in the inserted position. Interrupter 300 may be locked into the inserted position using a retainer or other mechanism to ensure interrupter 300 does not become dislodged from the inserted position during transport of the detonator assembly 250 to the wellsite 13. Additionally, in certain embodiments, block 656 may comprise manually inserting the interrupter 600 into the interrupter slot 542 of the lower endplate 530 of perforating gun 500.

Method 650 continues at block 658 by connecting a detonator to a switch configured to detonate the detonator in response to receiving a firing signal. In some embodiments, block 658 comprises electrically connecting the electrical cables 294 of detonator 290 to a switch of tool string 20, such as electrical switch shown particularly in FIG. 2. For example, electrical cables 294 of detonator 290 may be manually wired (e.g., crimped, soldered, etc.) to a pair of electrical signal conductors or cables 222 (shown in FIG. 2) extending from electrical switch. Electrical switch and/or detonator assembly 250 may be positionable within one of the perforating guns 100A, 100B, switch sub 200, or one or other components of tool string 20.

For example, with respect to perforating gun 100A shown in FIG. 2, the electrical switch and detonator assembly 250 positioned within the outer housing 202 of switch sub 200 may be associated with the upper perforating gun 100A whereby the electrical switch may be configured to (in response to receiving a firing signal from surface assembly 11) detonate the detonator 290 of the detonator assembly 250 and thereby fire or detonate the shaped charges 150 of upper perforating gun 100A.

Figure 12:
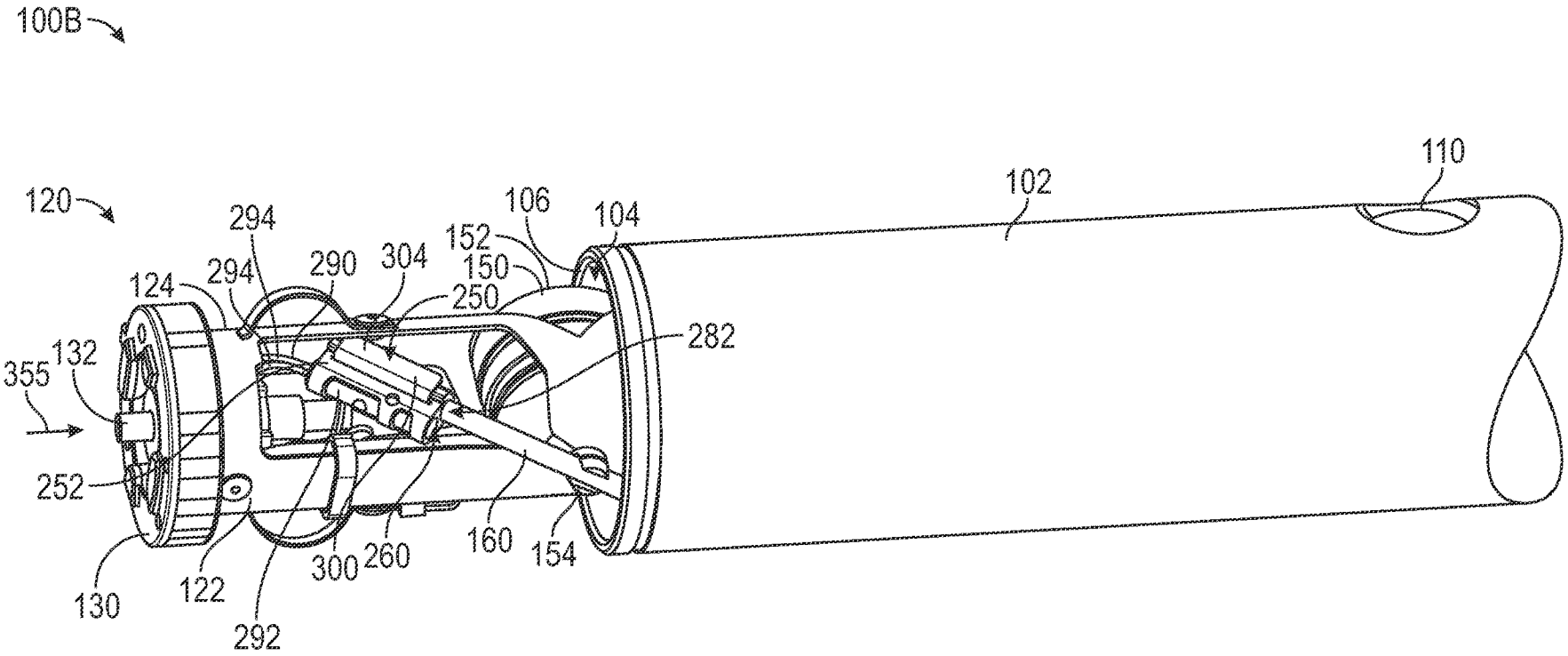
FIGS. 12, 13 are perspective views of another embodiment of a perforating gun.
Figure 13:
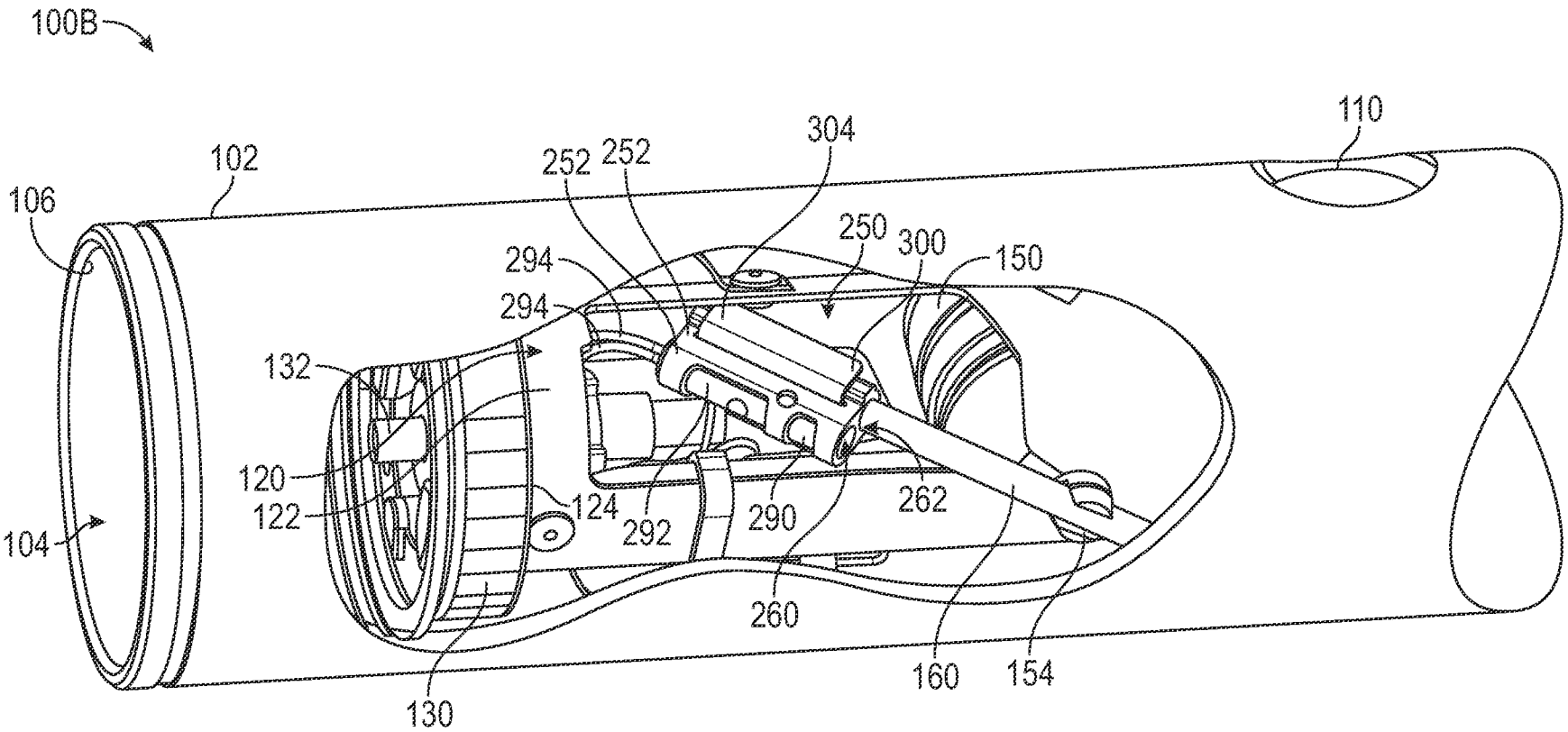

Referring briefly to FIGS. 12, 13, the lower perforating gun 100B of tool string 20 is shown. In the embodiment of FIGS. 12, 13, unlike upper perforating gun 100A where the electrical switch and detonator assembly 250 associated with upper perforating gun 100A are located external of perforating gun 100A, the electrical switch and detonator assembly 250 associated with lower perforating gun 100B (e.g., the electrical switch and detonator assembly 250 configured to fire or detonate the shaped charges 150 of lower perforating gun 100B) are positioned within the charge carrier 122 of lower perforating gun 100B. As will be described further herein, in other embodiments, electrical switch and/or detonator assembly 250 may be integrated with one of the endplates 130, 140 of charge carrier assembly 120. For instance, detonator holder 252 of detonator assembly 250 may be formed integrally and monolithically with one of the endplates 130, 140 of the charge carrier assembly 120. Referring generally to FIGS. 2-6, 12, and 13, with respect to lower perforating gun 100B, block 658 of method 650 may include assembling a charge carrier assembly 120 of one of the perforating guns 100A, 100B. The charge carrier assembly 120 may be assembled by coupling one or more shaped charges 150 to charge carrier 122, ballistically coupling the one or more shaped charges 150 to the detonating cord 160 associated with charge carrier assembly 120, and electrically connecting the detonator 290 of the detonator assembly 250 associated with the charge carrier assembly 120 with the electrical switch associated with the charge carrier assembly 120. The assembled charge carrier 120 may then be inserted into the outer housing 102 of lower perforating gun 100B (indicated by arrow 355 in FIG. 12). Thus, in the embodiment shown in FIGS. 12, 13, both the electrical switch and detonator assembly 250 may be positioned within the charge carrier 122 of the charge carrier assembly 120.

With respect to upper perforating gun 100A, block 658 of method 650 may include positioning the electrical switch and detonator assembly 250 associated with upper perforating gun 100A within the outer housing 202 of switch sub 200 (the det cord 160 being received within the second passage 262 of the detonator holder 252 of detonator assembly 250), coupling the lower end of upper perforating gun 100A to the upper end of switch sub 200, and electrically connecting the electrical switch to the detonator 290 of the detonator assembly 250. Radial port 208 of switch sub 200 may be utilized for accessing electrical switch and detonator assembly 250 when electrically connecting the electrical switch with the detonator assembly 250.

Electrical switch may also be electrically connected to the electrical cable 164 of upper perforating gun 100A via an electrical signal conductor or cable 224 extending from electrical switch and which may be electrically connected (e.g., crimped, soldered, etc.) with electrical cable 164. Additionally, electrical switch may further be electrically connected to lower perforating gun 100B (thereby providing signal connectivity between perforating guns 100A, 100B) by electrically connecting an electrical signal conductor or cable 226 extending from electrical switch with an electrical signal conductor or cable 236 extending from the electrical connector 232 of pressure bulkhead 230.

Referring again to FIG. 11, in some embodiments, block 658 may comprise connecting the detonator 580 to the switch 560 of the initiator assembly 550 shown in FIGS. 7-10. The step of connecting detonator 580 to switch 560 may be performed prior to blocks 652-656 and at a separate location from the location at which blocks 652-656 are performed. In some embodiments, detonator 580 may be soldered or otherwise rigidly connected to switch 560 as part of the process of forming initiator assembly 550.

Method 650 proceeds at block 660 by inserting the detonator into the detonator holder. In some embodiments, block 654 comprises manually inserting the housing 292 of detonator 290 into the first passage 260 (the direction of travel of detonator 290 is indicated by arrow 352 in FIG. 3) of the detonator holder 252 shown particularly in FIGS. 3-6. Detonator 290 may be inserted into detonator holder 252 such that housing 292 and at least a portion of det cord 160 extend parallel to each other but are laterally offset (e.g., offset by lateral spacing 265 shown in FIG. 3). Additionally, at least a portion of housing 292 and det cord 160 may laterally overlap whereby a lateral axis (e.g., lateral axis 267 shown in FIG. 4) extending orthogonal housing 292 and the portion of det cord 160 received within detonator holder 252 intersects or extends through both housing 292 and det cord 160.

In certain embodiments, block 660 may comprise inserting the detonator 580 of initiator assembly 550 into the detonator passage 540 of the detonator holder 548 of perforating gun 500. As described in greater detail above, detonator 580 may be inserted into detonator passage 540 as initiator assembly 550 is coupled to the lower endplate 530 of perforating gun 500.

The ordering of blocks 652-660 may vary depending on the embodiment. Additionally, in some embodiments, one or more of blocks 652-660 may be performed at one or more locations remote of a wellsite at which the assembled perforating gun will be used to perform an operation (e.g., a perforating operation). For example, in some embodiments, each of blocks 652-660 may be performed at the remote location.

For instance, in an embodiment, each detonator assembly 250 may be assembled in accordance with the blocks 652-660 and tool string 20 may be at least partially assembled at the remote location prior to transporting the tool string 20 to wellsite 13 for performing a perforating operation. In some embodiments, tool string 20 may be assembled "bottom up" beginning with the coupling of downhole plug 60 with setting tool 50, coupling setting tool 50 with PSFH 40, and so on and so forth. In some embodiments, electrical connector 232 of switch sub 200 may be electrically connected with the electrical cable 164 in response to threadably coupling the outer housing 102 of lower perforating gun 100B with the outer housing 202 of switch sub 200. However, following the threadable coupling of the outer housing 102 of upper perforating gun 100A with the outer housing 202 of switch sub 200, the electrical cables 222, 224, and 226 of the electrical switch of switch sub 200 may be manually connected with corresponding electrical cables 294, 164, and 236, respectfully, utilizing radial port 208 of outer housing 202.

In some embodiments, following the at least partial assembly of tool string 20, tool string 20 may be transported to the wellsite 13 with each det cord 160 received within the second passage 262 of a corresponding detonator holder 252 and the housing 292 of each detonator 290 received in the first passage 260 of a corresponding detonator holder 252. Interrupters 300 installed within each detonator holder 252 ensure that an inadvertent detonation of a detonator 290 during transportation of tool string 20 to the wellsite 13 does not result in the detonation of any of the shaped charges 150 of perforating guns 100A, 100B.

Once tool string 20 is located at the wellsite 13, interrupters 300 may be removed from each detonator holder 252 to permit the communication of a ballistic signal between the detonator 290 and det cord 160 of each detonator assembly 250. For example, the lower end of lower perforating gun 100B may be decoupled from PSFH 40, the charge carrier assembly 120 of lower perforating gun 100B may be removed from outer the outer housing 102 of lower perforating gun 100B, and the interrupter 300 may be manually removed from the detonator holder 252 of lower perforating gun 100B. In some embodiments, a retainer (not shown in FIGS. 2-9) locking interrupter 300 to the detonator holder 252 may be manually removed from interrupter 300 prior to extracting interrupter 300 from the detonator holder 252 (indicated by arrow 356 in FIG. 6) whereby interrupter 300 is no longer positioned between the detonator 290 and det cord 160 of the detonator assembly 250.

In some embodiments, the interrupter 300 of the detonator assembly 250 associated with upper perforating gun 100A may be removed by removing plug 210 from radial port 208 of switch sub 200 and manually removing interrupter 300 (via radial port 208) from the detonator holder 252 in a manner similar to that employed in removing the interrupter 300 from the detonator assembly 250 of lower perforating gun 100B. Following the removal of each interrupter 300 of tool string 20, tool string 20 may be reassembled at the well site 13 (e.g., lower perforating gun 100B may be reconnected to PSFH 40 and plug 210 may be repositioned within radial port 208 of switch sub 200) and tool string 20 may be lowered through the wellbore 4 to perform a hydraulic fracturing operation whereby the shaped charges 150 of each perforating gun 100A, 100B are selectably detonated via the surface assembly 11.

In some embodiments, perforating gun 500 may be assembled in accordance with blocks 652-660 described above at a location remote from the wellsite. Particularly, endcaps (not shown in FIGS. 7-10) may be coupled to the ends of housing 502 and the now assembled perforating gun 500 may be transported from the remote location to the wellsite (e.g., wellsite 13) for assembly with the other components of the tool string (e.g., tool string 20) comprising perforating gun 500.

At the wellsite, prior to being assembled with the tool string, the endcaps may be removed from housing 502 and interrupter 600 may be manually removed (e.g., via handle 602) from the interrupter slot 542 of lower endplate 530, thereby arming perforating gun 500 such that a ballistic connection is formed between the detonator 580 of initiator assembly 550 and the det cord 160 ballistically coupled to the one or more shaped charges 150 of perforating gun 500. The outer housing 502 of perforating gun 500 may then be coupled (e.g., threadably coupled) to components of the tool string and the assembled tool string may be lowered into a wellbore (e.g., wellbore 4) along a wireline (e.g., wireline 22) that is in signal communication with switch 560 of initiator assembly 550. Once perforating gun 500 is positioned at a desired location in the wellbore, one or more signals may be transmitted from the surface (e.g., from surface assembly 11) to the switch 560 of perforating gun 500 to detonate the one or more shaped charges 150 of perforating gun 500.

Embodiments disclosed herein include a detonator (e.g., detonators 290, 580) for a perforating gun (e.g., perforating guns 100A, 100B, 500) that is configured to detonate a combustible material in response to receiving a signal, a detonator holder (e.g., detonator holders 252, 358) comprising a passage (e.g., passages 260, 541) configured to receive a detonating cord (e.g., detonating cord 160), and a passage configured to receive the detonator (e.g., passages 262, 540), and an interrupter (e.g., interrupters 300, 600) removeably positionable within the detonator holder between the two passages, wherein the interrupter may comprise a first plate (e.g., first plate 302, 604) and a support member (e.g., second plate 304, 606) extending at a non-zero angle from the first plate.

As described above, the interrupter described herein may prevent or sever a ballistic connection between the detonator and the detonating cord received in the detonator holder. By preventing or severing the ballistic connection between the detonator and detonating cord, the perforating gun may be safely preassembled and transported from a remote location to a wellsite where the interrupter of each perforating gun may be removed. In this manner, the time required for assembling a tool string comprising the perforating guns described herein may be minimized, in-turn minimizing the costs of performing an operation (e.g., a completion operation) utilizing the perforating guns.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating gun system, comprising:

a detonator configured to detonate one or more shaped charge in response to receiving a signal;

a detonator holder comprising a pair of opposed longitudinal ends, a first passage extending along a first axis and configured to receive a detonating cord, and a second passage extending parallel to, but laterally offset from, the first passage, wherein the second passage is configured to receive the detonator; and an interrupter removeably positionable within the detonator holder laterally between the first passage and the second passage to block ballistic communication between the detonator and the detonating cord when the detonating cord is received in the first passage and the detonator is received in the second passage.

2. The perforating gun system of claim 1, wherein the detonator holder further comprises a first interrupter opening and a second interrupter opening positioned opposite the first interrupter opening, and wherein the interrupter is insertable through both the first interrupter opening and the second interrupter opening.

3. The perforating gun system of claim 1, wherein the interrupter comprises a first plate and a support member extending at a non-zero angle from the first plate whereby a bend is formed between the first plate and the support member.

4. The perforating gun system of claim 3, wherein the first plate comprises a first generally planar member and the support member comprises a second generally planar member.

5. The perforating gun system of claim 3, wherein the interrupter has a generally L-shaped cross-section.

6. The perforating gun system of claim 3, wherein the non-zero angle is between 60 degrees and 120 degrees.

7. The perforating gun system of claim 3, wherein the non-zero angle is between 80 degrees and 110 degrees.

8. The perforating gun system of claim 1, wherein the detonator holder comprises one or more lateral openings that extend entirely through the detonator holder, and wherein the one or more lateral openings are positioned laterally adjacent to the second passage.

9. The perforating gun system of claim 1, further comprising:

a cylindrical outer housing;

a charge carrier assembly receivable in the outer housing, wherein the charge carrier assembly comprises a charge carrier, the one or more shaped charges coupled to the charge carrier, a first endplate coupled to a first end of the charge carrier, and a second endplate coupled to the second charge carrier; and wherein the first endplate comprises the detonator holder.

10. A perforating gun system, comprising:

a detonator configured to detonate one or more shaped charges in response to receiving a signal;

a detonator holder comprising a pair of opposed longitudinal ends, a first passage configured to receive a detonating cord, and a second passage configured to receive the detonator; and an interrupter removeably positionable within the detonator holder between the first passage and the second passage to block ballistic communication between the detonator and the detonating cord when the detonating cord is received in the first passage and the detonator is received in the second passage, and wherein the interrupter comprises a first plate and a support member extending at a non-zero angle from the first plate whereby a bend is formed between the first plate and the support member.

11. The perforating gun system of claim 10, wherein the non-zero angle is between 60 degrees and 120 degrees.

12. The perforating gun system of claim 10, wherein the non-zero angle is between 80 degrees and 110 degrees.

13. The perforating gun system of claim 10, wherein the first plate comprises a first generally planar member and the support member comprises a second generally planar member.

14. The perforating gun system of claim 10, wherein a length of the first generally planar member is greater than a thickness of the first generally planar member.

15. The perforating gun system of claim 10, wherein the interrupter has a generally L-shaped cross-section.

16. The perforating gun system of claim 10, wherein the first passage extends parallel with, but laterally offset from, the second passage.

17. The perforating gun system of claim 10, wherein the detonator holder comprises a first interrupter opening and a second interrupter opening positioned opposite the first interrupter opening, and wherein the interrupter is insertable through both the first interrupter opening and the second interrupter opening.

18. The perforating gun system of claim 10, wherein the detonator holder comprises one or more openings that extend entirely through the detonator holder, and wherein the one or more openings are positioned adjacent to the second passage.

19. The perforating gun system of claim 10, further comprising:

a cylindrical outer housing;

a charge carrier assembly receivable in the outer housing, wherein the charge carrier assembly comprises a charge carrier, the one or more shaped charges coupled to the charge carrier, a first endplate coupled to a first end of the charge carrier, and a second endplate coupled to the second charge carrier; and wherein the first endplate comprises the detonator holder.

20. A method for assembling a perforating gun system, comprising:

(a) inserting an interrupter into a detonator holder positioned between a first passage and a second passage of the detonator holder, wherein the interrupter comprises a first plate and a support member extending at a non-zero angle from the first plate whereby a bend is formed between the first plate and the support member;

(b) inserting a detonating cord into the second passage of the detonator holder; and (c) inserting the detonator into the first passage of the detonator holder whereby ballistic communication between the detonator and the detonating cord is blocked by the interrupter.

21. The method of claim 20, further comprising:

(d) removing the interrupter from the detonator holder to enable a ballistic connection between the detonator and the detonating cord.

22. The method of claim 20, wherein the first plate comprises a first generally planar member and the support member comprises a second generally planar member.

23. The method of claim 20, wherein the first passage extends parallel with, but laterally offset from, the second passage.

* * * * *